US009646810B2

(12) United States Patent
Hyeon et al.

(10) Patent No.: US 9,646,810 B2
(45) **Date of Patent: *May 9, 2017**

(54) METHOD FOR IMPROVING MASS SPECTRUM REPRODUCIBILITY AND QUANTITATIVE ANALYSIS METHOD USING SAME

(71) Applicants: SNU R&DB FOUNDATION, Seoul (KR); ASTA CO. LTD., Gyeonggi-do (KR)

(72) Inventors: Taeghwan Hyeon, Seoul (KR); Myung Soo Kim, Seoul (KR); Yong Jin Bae, Seoul (KR); Kyung Man Park, Seoul (KR); Sung Hee Ahn, Gyeonggi-do (KR)

(73) Assignees: SNU R&DB FOUNDATION (KR); ASTA CO., LTD. (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/415,302

(22) PCT Filed: Jul. 17, 2013

(86) PCT No.: PCT/KR2013/006406

§ 371 (c)(1),
(2) Date: Jan. 16, 2015

(87) PCT Pub. No.: WO2014/014279

PCT Pub. Date: Jan. 23, 2014

(65) Prior Publication Data

US 2015/0221488 A1 Aug. 6, 2015

(30) Foreign Application Priority Data

Jul. 17, 2012 (KR) ..... 10-2012-0077986
Jan. 3, 2013 (KR) ..... 10-2013-0000816
Jan. 3, 2013 (KR) ..... 10-2013-0000817

(51) Int. Cl.
*H01J 49/00* (2006.01)
*H01J 49/16* (2006.01)

(52) U.S. Cl.
CPC ..... *H01J 49/0009* (2013.01); *H01J 49/0027* (2013.01); *H01J 49/164* (2013.01)

(58) Field of Classification Search
None
See application file for complete search history.

(56) References Cited

U.S. PATENT DOCUMENTS 3,548,188 A 12/1970 Nemeth et al.
5,015,845 A 5/1991 Allen et al.
(Continued)

FOREIGN PATENT DOCUMENTS

JP 2926773 B2 * 7/1999
JP 2006140064 A 6/2006
KR 10-2010-010802 A 10/2010

OTHER PUBLICATIONS

Samuel Carda-Broch et al., "Ionic Matrices for Matrix-Assisted DesorptionIIonization Time-of-Flight Detection of DNA Oligomers." Communications in Mass Spectrometry, 2003, vol. 17. pp. 553-560.

(Continued)

*Primary Examiner* — Andrew Smyth
(74) *Attorney, Agent, or Firm* — Dergosits & Noah LLP; Todd A. Noah

(57) ABSTRACT

Methods are described for improving reproducibility of mass spectrum and quantitative analysis method using the same. More particularly, methods for improving reproducibility of a mass spectrum of a chemical compound, wherein temperatures of an ion generation reaction are controlled to be the same with each other, or wherein spectra of which temperature of ion generation reaction are the same with each other are selected from mass spectra of a chemical (Continued)

compound are described. In addition, methods for measuring an equilibrium constant of a proton transfer reaction between a matrix and an analyte at a certain temperature, for obtaining a calibration curve for quantitative analysis, and for quantitative analysis of an analyte by using mass spectra area described.

3 Claims, 19 Drawing Sheets

(56) References Cited

U.S. PATENT DOCUMENTS

| | | | | |
|---|---|---|---|---|
| 9,349,578 | B2 * | 5/2016 | Kim | H01J 49/164 |
| 2006/0145089 | A1 | 7/2006 | Cristoni et al. | |
| 2011/0272573 | A1 * | 11/2011 | Kostrzewa | H01J 49/0027 250/282 |
| 2012/0318970 | A1 * | 12/2012 | Quimby | H01J 49/0036 250/282 |
| 2016/0148793 | A1 * | 5/2016 | Kim | H01J 49/0027 250/282 |

OTHER PUBLICATIONS

Gary R Kinsel et al. "Equilibrium conditions in laser-desorbed plumes: thermodynamic properties of a-cyano-4-hydroxycinnamic acid and protonation of amino acids," European Journal of Mass Spectrometry, 1M Publications, 2006, vol. 12, No. 6, pp. 359-367.

R. Knochenmuss et al., "MALDI Ionization: The Role of In-Plume Processes," Chemical Reviews, American Chemical Society, 2003, vol. 103. No. 2, pp. 441-452.

R. Knochenmuss et al., "The Matrix Suppression Effect in Matrix-assisted Laser Desorption/Ionization: Application to Negative Ions and Further Characteristics," Rapid Communications in Mass Spectrometry, 1998, vol. 12. No. 9, pp. 529-534.

R. Knochenmuss et al., "A Quantative Model of Ultraviolet Matrix-Assisted Laser Desorpton/Ionizaton Incuding Analyte Ion Generation," Analytical Chemistry, 2003, vol. 75, No. 10, pp. 2199-2207.

Amelie S. Benk et al., "Label-free quantification using MALDI mass spectrometry; considerations and perspectives," Analytical and Bioanalytical Chemistry, 2012, vol. 404, No. 4. pp. 1039-1056.

Masoud Zabet-Moghaddam et al. "Qualitative and quantitative analysis of low molecular weight compounds by ultraviolet matrix-assisted laser desorption/ionization mass spectrometry using ionic liquid matrices," Rapid Communications in Mass Spectrometry, 2004, vol. 18, No. 2, pp. 141-148.

Partial supplementary European Search Report of EP application No. 13820231.2.

Extended European Search Report of EP application No. 13820231.2.

* cited by examiner

METHOD FOR IMPROVING MASS SPECTRUM REPRODUCIBILITY AND QUANTITATIVE ANALYSIS METHOD USING SAME

CLAIM OF PRIORITY

This application claims the benefit of PCT Application No. PCT/KR2013/006406, filed Jul. 17, 2013, which claims priority to Korean Patent Application No. 10-2012-0077986, filed Jul. 17, 2012, Korean Patent Application No. 10-2013-0000816, filed Jan. 3, 2013 and Korean Patent Application No. 10-2013-0000817, filed Jan. 3, 2013, the entire contents of which are incorporated herein by reference.

TECHNICAL FIELD

The present method relates to improving reproducibility of mass spectrum and quantitative analysis method using the same. More particularly, the present methods are directed to methods for improving reproducibility of a mass spectrum of a chemical compound, wherein temperatures of an ion generation reaction are controlled to be the same with each other, or wherein spectra of which temperature of ion generation reaction are the same with each other are selected from mass spectra of a chemical compound. In addition, the present methods are directed to a method for: measuring an equilibrium constant of a proton transfer reaction between a matrix and an analyte at a certain temperature; obtaining a calibration curve for quantitative analysis; and quantitative analysis of an analyte by using mass spectra.

BACKGROUND

Figure 1:
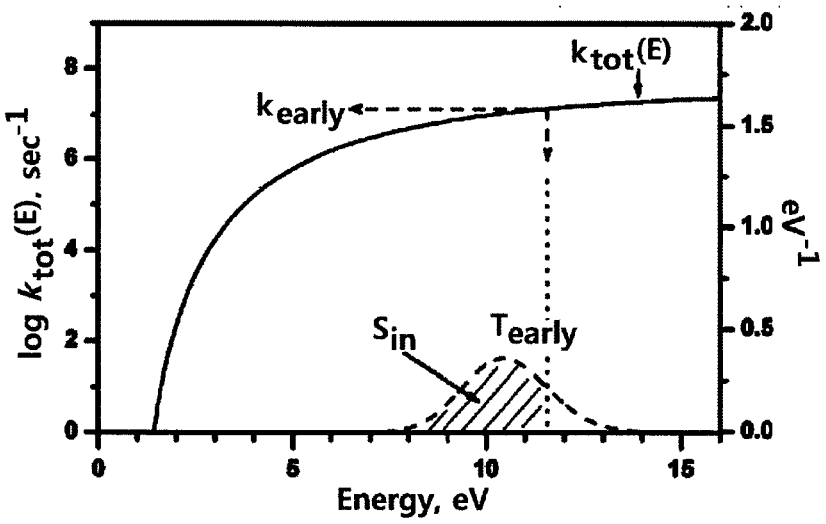
FIG. 1 is a schematic diagram illustrating an embodiment for obtaining the early plume temperature ($T_{early}$) of peptide ion $[Y_6+H]^+$ in Example 1.

Various solid samples can be ionized by matrix-assisted laser desorption/ionization (MALDI). Usually, MALDI is used as MALDI-TOF by combining with time-of-flight (TOF) mass spectrometer. Since a MALDI-TOF mass spectrometer (MS) is sensitive, widely applicable, and rapid to analyze samples, it is extensively used to analyze molecular structures of various solid substances, especially biological molecules.

However, since the reproducibility of MALDI mass spectra is very poor, it is difficult to utilize MALDI mass spectrometry for quantitative analysis of an analyte. For this reason, the industrial and scientific applicability of MALDI mass spectrometry is very limited.

Notwithstanding, various methods utilizing MALDI mass spectra, such as a relative quantitative analysis without using an internal standard, an absolute quantitative analysis using an internal standard, an absolute quantitative analysis by standard addition, etc., have been developed in order for quantitative analysis using MALDI mass spectra.

A relative quantitative analysis without an internal standard (or profile analysis) is a MALDI mass spectrometry that utilizes a classification algorithm, based on the fact that the relative signal intensity of each component in MALDI spectrum is constant, in order to analyze reproducibly a MALDI mass spectrum. However, the profile analysis has drawbacks that the design and performance of experiments are difficult.

In addition, a relative quantitative analysis with an internal standard is MALDI mass spectrometry that quantifies analytes by measuring the relative ratio of the peak height or area of each analyte to that of the internal standard from MALDI spectra of a sample containing the internal standard. However, the absolute amount of the analytes cannot be measured by the relative quantitative analysis with an internal standard.

Furthermore, an absolute quantitative analysis is MALDI mass spectrometry that obtains the absolute amount of an analyte by determining a calibration curve from a plurality of samples containing an internal standard with changing the amount of the analyte and, then, substituting the calibration curve with the relative quantity of the analyte obtained by a relative quantitative analysis with an internal standard. However, the absolute quantitative analysis has a drawback to obtain a calibration curve for each analyte for analyzing a sample containing a plurality of analytes.

Moreover, an absolute quantitative analysis by standard addition is MALDI mass spectrometry that determines the absolute amount of an analyte by using calibration points obtained from MALDI spectra of each sample which is prepared by dividing each unknown sample into two or more portions and adding known amount(s) of the analyte to these portions. However, the absolute quantitative analysis by standard addition has drawbacks to prepare an additional analyte to be analyzed, and many samples in order to analyze one analyte.

In order for quantitative analysis using MALDI spectra by the conventional methods, an internal standard, especially an isotopically labeled analyte, is used. However, it is very expensive to isotopically label the analyte such as high molecular weight material, for example, proteins, nucleic acids, etc., as well as low molecular weight material, for example, peptides. In addition, it is one of the drawbacks of quantitative MALDI mass spectrometry with an internal standard that pre-treatment of the analyte is not simple.

Since a MALDI sample is generally a mixture of an analyte and a matrix, MALDI spectra exhibit an analyte ion ($AH^+$) and its fragmented products, and a matrix ion ($MH^+$) and its fragmented products. Thus, MALDI spectral patterns are determined by the fragmentation patterns of $AH^+$ and $MH^+$ and the abundance (intensity) ratio of $AH^+$ and $MH^+$.

Ions generated by MALDI may decay inside the ion source (in-source decay, ISD) or outside the ion source (post-source decay, PSD). The reaction rate of ISD is fast and, thus, ISD terminates early. In contrast, the reaction rate of PSD is slow. These reaction rate and yield of fragmentation of the ions is determined by the reaction rate constant and the internal energy of the ions. Therefore, if the effective temperature of the plume generated by laser pulse in MALDI is found, the internal energy can be estimated and the reaction rate can be obtained by using the internal energy.

Many scientific researches to find out the temperature of the plume which includes ions generated by laser irradiation on MALDI samples and neutral molecules, have been carried out (*J. Phys. Chem.* 1994, 98, 1904-1909; *J. Am. Soc. Mass Spectrum.* 2007, 18, 607-616; *J. Phys. Chem. A* 2004, 108, 2405-2410).

However, the present inventors presented for the first time the best systematic method for measuring the plume temperature (*J. Phys. Chem. B* 2009, 108, 2405-2410). The present inventors succeeded in obtaining the reaction rate of ion fragmentation and the effective temperature by kinetic analysis of the time-resolved photodissociation spectra and the PSD spectra. In addition, the present inventors found out that the thus obtained temperature is the late plume temperature ($T_{late}$). The present inventors determined the early plume temperature ($T_{early}$) by analyzing ISD yields using the thus obtained reaction rate function.

Firstly, fragmented ion products abundance for ISD and PSD of peptide ions in MALDI mass spectra was measured. From these data, the survival probabilities of the peptide ion at the ion source exit ($S_{in}$) were evaluated. In consideration of experimental conditions, the maximum reaction constant at the ion source exit was obtained and, then, the maximum internal energy of the peptide ion was obtained from this maximum reaction constant. Varying the temperature, the internal energy distribution of the peptide ion was obtained and $T_{early}$ was determined to be the same temperature at which the probability of the region smaller than the maximum internal energy is equal to $S_{in}$.

The early and late temperatures of the ion-containing gas (plume), determined by the present inventors, were similar to those reported by other researchers. However, the method by the present inventors is much more systematic than the methods by other researchers and, thus, may be universally applicable (*Journal of The American Society for Mass Spectrometry,* 2011, vol. 22, pp 1070-1078). The disclosure of this prior document is incorporated herein by reference in its entirety.

Through these researches, the present inventors discovered, surprisingly, that, although the early plume temperature ($T_{early}$) changes with change of MALDI experimental conditions, the fragmentation patterns of each ion are the same, respectively, when observing the mass spectra where $T_{early}$ is the same, out of the spectra obtained at various experimental conditions.

Surprisingly, the present inventors also discovered that, although the temperature ($T_{early}$) at which ions are generated changes with change of the reaction conditions of the ion generation in MALDI, the total ion count (TIC) of each spectrum is the same, respectively, when observing the mass spectra where $T_{early}$ is the same, out of the spectra obtained at various experimental conditions.

Moreover, from the fact that the pattern of a mass spectrum as well as the total ion count (TIC) are the same when $T_{early}$ is the same, the present inventors further discovered that mass spectra at the same $T_{early}$ can be obtained when $T_{early}$ is kept constant by adjusting the laser pulse energy irradiated on a sample.

Accordingly, the present inventors have discovered that quantitative analysis by a mass spectrometer is possible since mass spectra of the same $T_{early}$ can be selected by utilizing the factors for measuring $T_{early}$, such as the ion fragmentation pattern and the total ion count in MALDI spectra.

Furthermore, the present inventors have discovered that the reaction quotient ($Q=[M][AH^+]/([MH^+][A])$) of the proton exchange reaction in plume obtained from MALDI spectra with the same $T_{early}$ remains constant regardless of the analyte concentration in a sample.

That is, the present inventors have understood that, in MALDI-TOF mass spectrometry, early plume is nearly in an equilibrium state and the reaction quotient (Q) corresponds to the reaction constant (K) of the proton exchange reaction between the matrix and the analyte. Therefore, the present inventors have noted that the analyte-to-matrix ion intensity of MALDI-TOF mass spectra obtained at a certain temperature is proportional to the analyte-to-matrix mole ratio in a solid sample and, thereby, quantitative analysis can be performed.

The present inventors have invented a method for measuring an equilibrium constant of a proton transfer reaction between a matrix and an analyte by measuring MALDI mass spectra with change of MALDI ionization reaction conditions, comparing fragmentation patterns of matrix ions, analyte ions or other additive's ions contained in MALDI samples, selecting spectra of which fragmentation patterns of these materials are the same, and measuring the ratio of the matrix ion signal intensity to the analyte ion signal intensity from the selected MALDI spectra.

Also, the present inventors have invented a method for obtaining a calibration curve according to change of concentration ratio of the matrix to the analyte at a certain temperature by utilizing the reaction constant between the matrix and the analyte.

In addition, the present inventors have invented a method for quantitative analysis of an analyte in a sample from the moles of the analyte obtained by substituting the calibration curve with the matrix concentration and the ratio of the matrix ion signal intensity to the analyte ion signal intensity measured from MALDI mass spectra of the sample prepared by mixing the known amount of the matrix and the unknown amount of the anlyte.

Furthermore, the present inventors have invented a method for improving accuracy of quantitative mass spectrometry by suppressing the matrix signal suppression effect through dilution of the anlyte when the matrix signal suppression effect is more than 70%, in order to solve the problem that makes an accurate quantitative analysis difficult due to decrease of the matrix ion signal intensity and other analyte ion signal intensity when the concentration of the anlyte in the sample is very high.

SUMMARY

Therefore, the first object of the present invention is to provide a method for improving reproducibility of a mass spectrum of a chemical compound, wherein temperatures of an ion generation reaction are controlled to be the same with each other, or wherein spectra of which temperature of ion generation reaction are the same with each other are selected from mass spectra of a chemical compound.

The second object of the present invention is to provide a method for measuring an equilibrium constant of a proton transfer reaction between a matrix and an analyte at a certain temperature, which comprises: (i) a step for selecting spectra of which fragmentation patterns of an analyte, a matrix or a third material are the same with each other, from a plurality of mass spectra obtained from ions generated by providing energy with a sample mixture comprising a matrix and an analyte, or a matrix, an analyte and a third material; and (ii) a step for obtaining an ion signal ratio calculated through dividing a signal intensity of an analyte ion shown in the spectra selected in the step (i) by a signal intensity of a matrix ion shown in the spectra selected in the step (i), wherein the equilibrium constant is obtained through dividing the ion signal ratio by a concentration ratio calculated through dividing an analyte concentration by a matrix concentration.

The third object of the present invention is to provide a method for obtaining a calibration curve for quantitative analysis, which comprises: (i) a step for selecting spectra of which fragmentation patterns of an analyte, a matrix or a third material are the same with each other, from a plurality of mass spectra obtained from ions generated by providing energy with a sample mixture comprising a matrix and an analyte, or a matrix, an analyte and a third material; (ii) a step for obtaining an ion signal ratio calculated through dividing a signal intensity of an analyte ion shown in the spectra selected in the step (i) by a signal intensity of a matrix ion shown in the spectra selected in the step (i); and (iii) a step for plotting a curve of the ion signal ratio against change of a concentration ratio calculated through dividing the analyte concentration by the matrix concentration.

The fourth object of the present invention is to provide a method for quantitative analysis of an analyte by using mass spectra, which comprises: (i) a step for selecting spectra of which fragmentation patterns of an analyte, a matrix or a third material are the same with each other, from a plurality of mass spectra obtained from ions generated by providing energy with a sample mixture comprising a known amount of a matrix and an unknown amount of an analyte, or a known amount of a matrix, an unknown amount of an analyte and the third material; (ii) a step for obtaining an ion signal ratio calculated through dividing a signal intensity of an analyte ion shown in the spectra selected in the step (i) by a signal intensity of a matrix ion shown in the spectra selected in the step (i); and (iii) a step of substituting the matrix concentration and the ion signal ratio measured in the step (ii) for the following equation (9) for calculating an analyte concentration, $$[A]=(I_{AH+}/I_{MH+})[M]/K \quad (9)$$

where K means a slope of a calibration curve ([A]/[M] versus $I_{AH+}/I_{MH+}$), or means an equilibrium constant of a proton transfer reaction between the matrix and the analyte.

DETAILED DESCRIPTION

The first object of the present invention can be accomplished by providing a method for improving reproducibility of a mass spectrum of a chemical compound, wherein temperatures of an ion generation reaction are controlled to be the same with each other, or wherein spectra of which temperature of ion generation reaction are the same with each other are selected from mass spectra of a chemical compound.

The described method for improving reproducibility of a mass spectrum of a chemical compound may comprise a step for selecting mass spectra of which fragmentation patterns of a compound selected from the group consisting of a matrix, an analyte and a third material, are the same with each other.

In addition, the method for improving reproducibility of a mass spectrum of a chemical compound may comprise a step for selecting mass spectra of which total ion counts are the same with each other.

The second object of the present invention can be accomplished by providing a method for measuring an equilibrium constant of a proton transfer reaction between a matrix and an analyte at a certain temperature, which comprises: (i) a step for selecting spectra of which fragmentation patterns of an analyte are the same with each other, from a plurality of mass spectra obtained from ions generated by providing energy with a sample mixture comprising a matrix and an analyte; and (ii) a step for obtaining an ion signal ratio calculated through dividing a signal intensity of an analyte ion shown in the spectra selected in the step (i) by a signal intensity of a matrix ion shown in the spectra selected in the step (i), wherein the equilibrium constant is obtained through dividing the ion signal ratio by a concentration ratio calculated through dividing an analyte concentration by a matrix concentration.

In addition, the second object of the present invention can be accomplished by providing a method for measuring an equilibrium constant of a proton transfer reaction between a matrix and an analyte at a certain temperature, which comprises: (i) a step for selecting spectra of which fragmentation patterns of a matrix are the same with each other, from a plurality of mass spectra obtained from ions generated by providing energy with a sample mixture comprising a matrix and an analyte; and (ii) a step for obtaining an ion signal ratio calculated through dividing a signal intensity of an analyte ion shown in the spectra selected in the step (i) by a signal intensity of a matrix ion shown in the spectra selected in the step (i), wherein the equilibrium constant is obtained through dividing the ion signal ratio by a concentration ratio calculated through dividing an analyte concentration by a matrix concentration.

Furthermore, the second object of the present invention can be accomplished by providing a method for measuring an equilibrium constant of a proton transfer reaction between a matrix and an analyte at a certain temperature, which comprises: (i) a step for selecting spectra of which fragmentation patterns of a third material are the same with each other, from a plurality of mass spectra obtained from ions generated by providing energy with a sample mixture comprising a matrix, an analyte and a third material; and (ii) a step for obtaining an ion signal ratio calculated through dividing a signal intensity of an analyte ion shown in the spectra selected in the step (i) by a signal intensity of a matrix ion shown in the spectra selected in the step (i), wherein the equilibrium constant is obtained through dividing the ion signal ratio by a concentration ratio calculated through dividing an analyte concentration by a matrix concentration.

According to the method for measuring an equilibrium constant of a proton transfer reaction between a matrix and an analyte at a certain temperature, a means for providing the energy with the sample mixture may be a laser, or various types of electromagnetic waves including a particle beam, other radioactive rays, etc. In addition, the laser may be a nitrogen ($N_2$) laser or a Nd:YAG laser. Furthermore, the laser may be irradiated to a single spot on the sample mixture for a plurality of times.

As used herein, the term "matrix" refers to a material that absorbs energy from an energy source such as laser and, then, transfers the energy to an anslyte thereby causing heating and ionization of the analyte. Various materials such as CHCA (α-cyano-4-hydroxycinnamic acid), DHB (2,5-dihydroxybenzoic acid), sinapinic acid (3,5-dimethoxy-4-hydroxycinnamic acid), 4-hydroxy-3-methoxycinnamic acid, picolinic acid, 3-hydroxypicolinic acid, etc. are known in the art.

According to an embodiment, a means for providing the energy with the sample mixture is generally a laser, and may be various types of electromagnetic waves including particle beams, radioactive rays, etc.

In a typical MALDI mass spectrometry, a solid sample consisting of a matrix (M) and a trace of an analyte (A) is irradiated by laser pulses. The matrix absorbs the laser pulses, heats the solid sample and facilitates ionization of solid sample. MALDI mass spectra are the spectra of a mixture of matrix ions and analyte ions.

As used herein, the term "total ion count (TIC)" means the total number of particles detected in the detector inside a mass spectrometer. Since a part of ions generated by MALDI becomes disassociated and lost, it is difficult to measure the total number of ions generated by MALDI. Hence, the total number of particles detected by the detector, which is equivalent to the total number of ions, is defined as a total ion count.

As used herein, the term "plume" refers to a vapor that is generated from a sample by irradiation of a laser on the sample. Plume contains gaseous matrix molecules, analyte molecules, matrix ions and analyte ions, most of which is the gaseous matrix ions.

As used herein, the term "reaction quotient" is defined as $Q=([C]^c[D]^d)/([A]^a[B]^b)$ in a reaction, $aA+b \leftrightarrow cC+dD$. When the chemical reaction is in equilibrium, the reaction quotient equals to the reaction constant.

As used herein, the term "calibration curve" or "calibration equation" refers to a curve that is experimentally obtained and illustrates a correlation between a concentration of a component and a specific property (for example, electric property, color, etc.). A calibration curve is used for quantifying an unknown material.

As used herein, the term "ion signal ratio" is defined as a ratio of a signal intensity of an analyte ion ($I_{AH+}$) to a signal intensity of a matrix ion ($I_{MH+}$), i.e., $I_{AH+}/I_{MH+}$. In addition, as used herein, the term "concentration ratio" is defined as a ration of moles of an analyte contained in a sample to moles of a matrix in the sample ([A]/[M]).

Ions shown in MALDI mass spectra are a protonated analyte ($AH^+$), a protonated matrix ($MH^+$), and their fragmented products generated inside an ion-source. Therefore, MALDI mass spectral pattern is determined by a fragmentation pattern of $AH^+$ and $MH^+$, and an analyte ion-to-matrix ion abundance ratio.

The present inventors disclosed a method for determining an early plume temperature ($T_{early}$) in MALDI (Bae, Y. J.; Moon, J. H.; Kim, M. S., *J. Am. Soc. Mass Spectrom.* 2011, 22, 1070-1078; Yoon, S. H.; Moon J. H.; Kim, M. S., *J. Am. Soc. Mass Spectrom.* 2010, 21, 1876-1883). In addition, the present inventors discovered that all of the three factors are determined when $T_{early}$ is specified. The disclosures of these prior documents are incorporated herein by reference in their entirety.

Moreover, when changing various conditions of the ion generation reaction, the temperature ($T_{early}$) at which ions are generated changes and, however, when selecting spectra of which ion generation temperatures are the same with each other, from a plurality of mass spectra obtained at various experimental conditions, each fragmentation pattern is the same with each other. These phenomena are also shown in the case of a matrix and a third material, as well as an analyte.

Therefore, the reproducibility of ion fragmentation pattern in MALDI mass spectra is accomplished by measuring several times MALDI mass spectra with change of MALDI ionization reaction conditions, comparing fragmentation patterns of matrix ions, analyte ions or a third material ions contained in MALDI samples, and selecting spectra of which fragmentation patterns of these materials are the same, that is, the temperature at which ions are generated are the same.

Furthermore, when changing various conditions of the ion generation reaction, the temperature ($T_{early}$) at which ions are generated changes, but when selecting spectra of which ion generation temperatures are the same with each other, from a plurality of mass spectra obtained at various experimental conditions, the total ion count (TIC) of each spectrum is the same with each other. These phenomena are also shown in the case of a matrix and a third material, as well as an analyte.

That is, MALDI spectrum includes an analyte ion, a matrix ion and their fragmented products, and it is possible to obtain reproducible MALDI spectra in which relative and absolute ion intensity of each ion is the same regardless of experimental conditions when selecting MALDI spectra having a specific $T_{early}$. In addition, it was discovered that TIC is the same when $T_{early}$ is the same, regardless of identities, concentrations and number of analytes contained in a sample.

Therefore, the MALDI mass spectral reproducibility is secured by measuring MALDI spectra several time with changing MALDI ionization conditions, and selecting MALDI spectra with the same total ion count (TIC) from each spectrum set.

With all the experimental conditions fixed, $T_{early}$ of MALDI spectra obtained by irradiation of laser pulses on a sample gradually decreases. This is because the thermal conduction from the irradiated sample to a plate on which the sample is placed occurs efficiently as the thickness of the sample gets thinner (Anal. Chem. 2012, 84, 7107-7111). This decrease of $T_{early}$ is one the main reasons to damage the shot-to-shot reproducibility of MALDI spectra.

According to an embodiment, in order to obtain MALDI spectra having constant TIC, i.e., $T_{early}$, it is required to get MALDI spectra having constant $T_{early}$ by increasing laser pulse energy when $T_{early}$ decreases as the thickness of the sample gets thinner. In detail, for example, a circular neutral density filter is used to adjust the laser pulse energy. The laser pulse energy is adjusted by rotating the filter to a desired angle, which is mounted on a step motor.

The feedback control of the laser pulse energy may be performed as follows. First, the TIC at which the laser pulse energy corresponding to 2 times the threshold energy is used may be set as a reference value. After obtaining MALDI spectra by irradiation of laser pulses, TIC corresponding to the MALDI spectra is calculated. Then, the rotational direction and angle for the circular neutral density filter are determined by calculating the discrepancy between the TIC and the reference TIC. Such feedback control is terminated when the laser pulse energy becomes three times the threshold. MALDI spectra are obtained by repetition of this procedure on each irradiated spot.

In MALDI plume, the proton exchange reaction of following reaction (1) between a matrix and an analyte occurs:

$$MH^+ + A \rightarrow M + AH^+ \quad (1)$$

The reaction quotient of the reaction (1) is defined as the following equation (2).

$$Q = [M][AH^+]/([MH^+][A]) = ([M]/[A])/([MH^+]/[AH^+]) \quad (2)$$

In the equation (2), the value of [M]/[A] can be directly obtained from the concentrations of the matrix and analyte used for preparation of a sample.

Moreover, in the equation (2), $[AH^+]/[MH^+]$ is the value calculated by dividing the concentration of the analyte-derived ions by the concentration of the matrix-derived ions, and is the same as the value (ion signal ratio) calculated by dividing the signal intensity of the analyte-derived ions by the signal intensity of the matrix-derived ions, which is obtained in the (ii) step of the method for measuring an reaction quotient of a proton transfer (exchange) reaction according to an embodiment, i.e., $I_{AH+}/I_{MH+}$. Accordingly, the equation (2) can be rewritten as follows.

$$Q = ([M]/[A])/(I_{AH+}/I_{MH+}) \quad (3)$$

That is, since both [M]/[A] and $I_{AH+}/I_{MH+}$ can be obtained, the reaction quotient of the proton exchange reaction between the matrix and the analyte can be calculated and the reaction quotient equals to the reaction constant since this reaction is in an equilibrium state.

In MALDI of most biological analytes (A), the analyte ion ($[A+H]^+$) is produced by proton transfer (equation (1)) from the matrix ion ($[M+H]^+$). Thus, when the concentration of the analyte such as a peptide in a sample is very high, matrix ion signals decrease and other analyte(s) ion signals also decrease.

As used herein, the term "matrix signal suppression effect" refers to a phenomenon that matrix ion signals decrease when the concentration of an analyte in a sample is very high. In addition, as used herein, the term "analyte signal suppression effect" refers to a phenomenon that, when the concentration of an analyte in the sample is very high, other analyte ion signals in a sample decrease.

According to the equation (3) in respect of a reaction quotient, the number of matrix ions decrease as the number of analyte ions increase, and this phenomenon is referred to as the "normal signal suppression" in the present specification. In addition, when the concentration of an analyte is very high, i.e., the matrix signal suppression effect is very large, ($I_{AH+}/I_{MH+}$) versus [A] curve deviates from linearity, and this phenomenon is referred to as the "anomalous signal suppression" in the present specification.

Parts of $MH^+$ become $MH\text{-}H_2O^+$, $MH\text{-}CO_2^+$, etc. through the in-source decay and, therefore, the total number of matrix-derived ions generated in MALDI is the sum of them. Furthermore, the number of matrix ions generated in MALDI is proportional to the number of MR shown in a MALDI spectrum. Thus, the number of $MH^+$ shown in MALDI spectrum is used in the present methods, instead of the total number of matrix ions.

$I_0$ is defined as the ion signal intensity of $MH^+$ in a MALDI spectrum of a pure matrix, and I is defined as the ion signal intensity of $MH^+$ in a MALDI spectrum of a matrix-analyte mixture. Then, the matrix signal suppression effect (S) of the mixture is defined as the following equation (4):

$$S = 1 - I/I_0 \quad (4)$$

Results of measurement of many analytes show that deviation from linearity occurs when the matrix signal suppression effect is larger than 70%. This can be utilized as a guideline for quantitative analysis of a sample. That is, the present inventors obtained MALDI spectra of a sample and, then, calculated the matrix signal suppression effect. When the matrix signal suppression is 70% or lower, the mass spectra can be used for quantitative analysis of an analyte.

When the matrix signal suppression effect of a sample is more than 70%, the matrix signal suppression effect can be decreased by dilution, using the following equation (5).

$$c_2/c_1 = (S_1^{-1} - 1)/(S_2^{-1} - 1) \quad (5)$$

In the above equation (5), $S_1$ and $S_2$ denote the matrix signal suppression effects when concentrations of an analyte 1 and an analyte 2 are $c_1$ and $c_2$, respectively.

Therefore, when the matrix signal suppression effect is more than 70% due to excess of the analyte in a sample, the analyte of the sample may be diluted by a factor of 2, preferably a factor of several to several hundreds.

The third object of the present invention can be accomplished by providing a method for obtaining a calibration curve for quantitative analysis, which comprises: (i) a step for selecting spectra of which fragmentation patterns of an analyte are the same with each other, from a plurality of mass spectra obtained from ions generated by providing energy with a sample mixture comprising a matrix and an analyte; (ii) a step for obtaining an ion signal ratio calculated through dividing a signal intensity of an analyte ion shown in the spectra selected in the step (i) by a signal intensity of a matrix ion shown in the spectra selected in the step (i); and (iii) a step for plotting a curve of the ion signal ratio against change of a concentration ratio calculated through dividing the analyte concentration by the matrix concentration.

In addition, the third object of the present invention can be accomplished by providing a method for obtaining a calibration curve for a quantitative analysis, which comprises: (i) a step for selecting spectra of which fragmentation patterns of a matrix are the same with each other, from a plurality of mass spectra obtained from ions generated by providing energy with a sample mixture comprising a matrix and an analyte; (ii) a step for obtaining an ion signal ratio calculated through dividing a signal intensity of an analyte ion shown in the spectra selected in the step (i) by a signal intensity of a matrix ion shown in the spectra selected in the step (i); and (iii) a step for plotting a curve of the ion signal ratio against change of a concentration ratio calculated through dividing the analyte concentration by the matrix concentration.

Moreover, the third object of the present invention can be accomplished by providing a method for obtaining a calibration curve for quantitative analysis, which comprises: (i) a step for selecting spectra of which fragmentation patterns of a third material are the same with each other, from a plurality of mass spectra obtained from ions generated by providing energy with a sample mixture comprising a matrix, an analyte and the third material; (ii) a step for obtaining an ion signal ratio calculated through dividing a signal intensity of an analyte ion shown in the spectra selected in the step (i) by a signal intensity of a matrix ion shown in the spectra selected in the step (i); and (iii) a step for plotting a curve of the ion signal ratio against change of a concentration ratio calculated through dividing the analyte concentration by the matrix concentration.

According to the method for obtaining a calibration curve for quantitative analysis, a means for providing the energy with the sample mixture may be a laser, or various types of electromagnetic waves including a particle beam, other radioactive rays, etc. In addition, the laser may be a nitrogen ($N_2$) laser or a Nd:YAG laser. Furthermore, the laser may be irradiated to a single spot on the sample mixture for a plurality of times.

In addition, according to the method for obtaining a calibration curve for quantitative analysis, a calibration curve for MALDI quantitative analysis may be obtained by linear regression of the ion signal ratio versus the concentration ratio which is obtained by repetition of the (i) step to the (iii) step with change of the analyte concentration and with the matrix concentration fixed.

As mentioned above, the fact that the analyte-to-matrix ion signal ratio is determined by $T_{early}$ indicates that the proton exchange reaction is in an equilibrium state. Whether or not the reaction (1) is in a thermal equilibrium state may be confirmed by check whether or not the reaction quotient (Q) for a sample with different concentration of an analyte at the same $T_{early}$ changes with the concentration of the analyte.

The present inventors obtained spectra in which $T_{early}$ is the same but the composition of a sample is different, by obtaining MALDI spectra through repetitive irradiation of laser pulses on many samples with different analyte concentrations, followed by selecting spectra having a specific $T_{early}$. In addition, from the thus-obtained spectra, the present inventors measured intensities of ions derived from the matrix and the analyte.

After the reaction quotient was obtained by substituting the equation (3) with the ion signal ratio (the value obtained by dividing the analyte ion signal intensity by the matrix ion signal intensity) and the concentrations of the matrix and the analyte in the sample, the present inventors discovered that, when $T_{early}$ is the same, the reaction quotient remains constant, even though the concentration of the analyte in the sample is different. Such results indicate that the reaction (1) is in an equilibrium state.

Since the proton exchange reaction between the matrix and the analyte is in an equilibrium state, the reaction quotients of the reactions (2) and (3) can be substituted by the reaction constant (K) and, in this case, the equations (2) and (3) become the equation (6).

$$K=[M][AH^+]/([MH^+][A])=([AH^+]/[MH^+])/([A]/[M])=(I_{AH+}/I_{MH+})/([A]/[M]) \quad (6)$$

Since the amount of ions is much less than that of neutral molecules in MALDI, [A]/[M] in a solid sample is set to be the corresponding ratio in MALDI plume. The equation (6) may be modified to the following calibration curves of the equations (7) and (8).

$$[AH^+]/[MH^+]=K([A]/[M]) \quad (7)$$

$$\text{Or, } I_{AH+}/I_{MH+}=K([A]/[M]) \quad (8)$$

A slope of the calibration curve, i.e., a reaction constant can be calculated by the equation (8), from only one measured $I_{AH+}/I_{MH+}$ value and one [A]/[M] value.

Furthermore, a reaction constant, i.e., the slope of the equation (8) can be calculated by statistical treatment, i.e., linear regression of a plurality of measured $I_{AH+}/I_{MH+}$ values and [A]/[M] values.

According to an embodiment, a straight line with a slope of K can be obtained by setting $I_{AH+}/I_{MH+}$ (i.e., $[AH^+]/[MH^+]$) to be the longitudinal axis and by setting [A]/[M] to be the horizontal axis. This straight line is the calibration curve (or calibration equation) for MALDI quantitative analysis.

When the matrix signal suppression effect is more than 70% due to excess of the analyte in a sample, the analyte of the sample may be diluted by a factor of 2, preferably a factor of several to several hundreds.

The fourth object of the present invention can be accomplished by providing a method for quantitative analysis of an analyte by using mass spectra, which comprises: (i) a step for selecting spectra of which fragmentation patterns of an analyte are the same with each other, from a plurality of mass spectra obtained from ions generated by providing energy with a sample mixture comprising a known amount of a matrix and an unknown amount of an analyte; (ii) a step for obtaining an ion signal ratio calculated through dividing a signal intensity of an analyte ion shown in the spectra selected in the step (i) by a signal intensity of a matrix ion shown in the spectra selected in the step (i); and (iii) a step of substituting the matrix concentration and the ion signal ratio measured in the step (ii) for the following equation (9) for calculating an analyte concentration, $$[A]=(I_{AH+}/I_{MH+})[M]/K \quad (9)$$

where K means a slope of a calibration curve ([A]/[M] versus $I_{AH+}/I_{MH+}$), or means an equilibrium constant of a proton transfer reaction between the matrix and the analyte.

In addition, the fourth object of the present invention can be accomplished by providing a method for quantitative analysis of an analyte by using mass spectra, which comprises: (i) a step for selecting spectra of which fragmentation patterns of a matrix are the same with each other, from a plurality of mass spectra obtained from ions generated by providing energy with a sample mixture comprising a known amount of a matrix and an unknown amount of an analyte; (ii) a step for obtaining an ion signal ratio calculated through dividing a signal intensity of an analyte ion shown in the spectra selected in the step (i) by a signal intensity of a matrix ion shown in the spectra selected in the step (i); and (iii) a step of substituting the matrix concentration and the ion signal ratio measured in the step (ii) for the following equation (9) for calculating an analyte concentration, $$[A]=(I_{AH+}/I_{MH+})[M]/K \quad (9)$$

where K means a slope of a calibration curve ([A]/[M] versus $I_{AH+}/I_{MH+}$), or means an equilibrium constant of a proton transfer reaction between the matrix and the analyte.

Moreover, the fourth object of the present invention can be accomplished by providing a method for quantitative analysis of an analyte by using mass spectra, which comprises: (i) a step for selecting spectra of which fragmentation patterns of a third material are the same with each other, from a plurality of mass spectra obtained from ions generated by providing energy with a sample mixture comprising a known amount of a matrix, an unknown amount of an analyte, and the third material; (ii) a step for obtaining an ion signal ratio calculated through dividing a signal intensity of an analyte ion shown in the spectra selected in the step (i) by a signal intensity of a matrix ion shown in the spectra selected in the step (i); and (iii) a step of substituting the matrix concentration and the ion signal ratio measured in the step (ii) for the following equation (9) for calculating the analyte concentration, $$[A]=(I_{AH+}/I_{MH+})[M]/K \quad (9)$$

where K means a slope of a calibration curve ([A]/[M] versus $I_{AH+}/I_{MH+}$), or means an equilibrium constant of a proton transfer reaction between the matrix and the analyte.

According to a method for quantitative analysis of an analyte by using mass spectra, a means for providing the energy with the sample mixture may be a laser, or various types of electromagnetic waves including a particle beam, other radioactive rays, etc. In addition, the laser may be a nitrogen ($N_2$) laser or a Nd:YAG laser. Furthermore, the laser may be irradiated to a single spot on the sample mixture for a plurality of times.

As mentioned above, according to the equation (8), $I_{AH+}/I_{MH+}$ is proportional to [A]/[M], which means that an analyte in a solid sample can be measured by measuring $I_{AH+}/I_{MH+}$ in MALDI mass spectrum. The equation (8) is modified to the following equation (9).

$$[A]=(I_{AH+}/I_{MH+})[M]/K=(I_{AH+}/I_{MH+})[M]/Q \quad (9)$$

That is, the equation (9) can be utilized to obtain the absolute quantity of the analyte in quantitative analysis using MALDI mass spectrometry.

In detail, the concentration of the analyte, [A], can be calculated from the calibration curve (the equation (9)) obtained by a method for obtaining a calibration curve for MALDI quantitative analysis by using the ratio of the analyte ion signal intensity to the matrix ion signal intensity obtained in the step (iii) of the method for quantitative analysis of an analyte by using mass spectra, i.e., $I_{AH+}/I_{MH+}$, and the known concentration of the matrix, [M].

Since the equilibrium state of a chemical reaction remains even when other chemical reactions are simultaneously in equilibrium states, the equation (9) may be applicable to other components in the matrix plume. That is, even in the case that the sample or the analyte is severely contaminated, quantitative analysis of the analyte in the specific sample is possible utilizing MALDI-TOF mass spectra. Therefore, according to an embodiment, it is possible to quantify various components in the mixture containing various materials, simultaneously.

When the matrix signal suppression effect is more than 70% due to excess of the analyte in a sample, the analyte of the sample may be diluted by a factor of 2, preferably a factor of several to several hundreds.

Advantageous Effects

According to an embodiment, a quantitative analysis of extremely small amount of an analyte can be performed inexpensively, accurately and rapidly by obtaining the analyte-to-matrix ion ratio from MALDI mass spectra and, from this, plotting a calibration curve for quantitative analysis.

In addition, according to an embodiment, even though the analyte to be analyzed is one component in a mixture or an anlyte is severely contaminated, it is possible to accurately and reproducibly perform a rapid and simple quantitative analysis by using MALDI mass spectra.

Hereinafter, the present methods will be described in greater detail with reference to the following examples and drawings. The examples and drawings are given only for purposes of illustration and are not to be deemed as limiting.

EXPERIMENTS

The MALDI-TOF instrument manufactured by the present inventors was used (Bae, Y. J.; Shin, Y. S.; Moon, J. H.; Kim. M. S. *J. Am. Soc. Mass Spectrom.* in press; Bae, Y. J.; Yoon, S. H.; Moon, J. H.; Kim, M. S. *Bull. Korean Chem. Soc.* 2010, 31, 92-99; Yoon, S. H.; Moon, J. H.; Choi, K. M.; Kim, M. S. *Rapid Commun. Mass Spectrom.* 2006, 20, 2201-2208). One of the key features of the instrument is the installation of a reflectron with linear-plus-quadratic potential inside (Oh, J. Y.; Moon, J. H.; Kim, M. S. *J. Am. Soc. Mass Spectrom.* 2004, 15, 1248-1259; Bae, Y. J.; Yoon, S. H.; Moon, J. H.; Kim, M. S. *Bull. Korean Chem. Soc.* 2010, 31, 92-99). This allows the simultaneous detection of prompt ions and their ISD and PSD products (Bae, Y. J.; Moon, J. H.; Kim, M. S. *J. Am. Soc. Mass Spectrom.* 2011, 22, 1070-1078).

Unless otherwise specified, 337 nm output from a nitrogen laser (MNL100, Lasertechnik Berlin, Berlin, Germany) focused by an f=100 mm lens was used for MALDI. Also used was 355 nm output from an Nd:YAG laser (SL III-10, Continuum, Santa Clara, Calif., USA) focused by the same lens.

In order to improve the signal-to-noise ratio, spectral data from every twenty laser shots were summed. Then, the results at the same shot number interval collected from twenty different spots on a sample were summed. Hence, each point in such spectra corresponds to summation over four hundred shots. Method to evaluate the number of ions in each peak was reported previously (Bae, Y. J.; Shin, Y. S.; Moon, J. H.; Kim. M. S. *J. Am. Soc. Mass Spectrom.* in press; Moon, J. H.; Shin, Y. S.; Bae, Y. J.; Kim, M. S. *J. Am. Soc. Mass Spectrom.* 2012, 23, 162-170).

The threshold laser pulse energy, or threshold, for CHCA-MALDI of peptides at 337 nm was 0.50 μJ/pulse. This was a little smaller than 0.75 μJ/pulse reported previously (Bae, Y. J.; Shin, Y. S.; Moon, J. H.; Kim. M. S. *J. Am. Soc. Mass Spectrom.* in press; Moon, J. H.; Shin, Y. S.; Bae, Y. J.; Kim, M. S. *J. Am. Soc. Mass Spectrom.* 2012, 23, 162-170), due to a better beam shaping. The threshold at 355 nm was around 0.40 μJ/pulse.

As analytes, peptides $Y_5X$ (Y=tyrosine, X=K (lysine) or R (arginine); Peptron (Daejeon, Korea)), angiotensin II (DRVYIHPF; Sigma, St. Louis, Mo., USA) and CHCA (Sigma, St. Louis, Mo., USA) were used. Aqueous stock solution of each peptide was diluted to a desired concentration and mixed with water/acetonitrile solution of CHCA. 1 μL of each mixture was loaded on the target and vacuum-dried. A sample contained 1 or 3 pmol of a peptide in 25 nmol of CHCA.

Example 1

Method to Estimate $T_{early}$

The kinetic method to estimate the early plume temperature reported by the present inventors (Bae, Y. J.; Moon, J. H.; Kim, M. S. *J. Am. Soc. Mass Spectrom.* 2011, 22, 1070-1078; Yoon, S. H.; Moon, J. H.; Kim, M. S. *J. Am. Soc. Mass Spectrom.* 2010, 21, 1876-1883) was used.

At first, the product ion abundances for ISD, PSD, and PSD of ISD products were measured from a MALDI-TOF spectrum. From these data, the survival probabilities of the peptide ion at the source exit ($S_{in}$) and at the detector ($S_{post}$) were evaluated. In the case of dissociation of $[Y_6+H]^+$, its total dissociation rate constant, k(E), was known from the previous time-resolved photodissociation study (Yoon, S. H.; Moon, J. H.; Kim, M. S. *J Am. Soc. Mass Spectrom.* 2009, 20, 1522-1529). In the kinetic analysis, 50 ns was taken as the threshold lifetime for ISD, which corresponded to $1.4\times10^7$ $s^{-1}$ in rate constant, or, 13.157 eV in internal energy as read from k(E). Then, the effective temperature in the early plume was determined such that the area below 13.157 eV in the internal energy distribution became $S_{in}$. The late plume temperature was determined similarly, using $5.4\times10^4$ $s^{-1}$ as the threshold rate constant. $T_{early}$ determined in this Example is somewhat higher than 881 K reported in a previous study because the laser fluence was larger (Bae, Y. J.; Moon, J. H.; Kim, M. S. *J. Am. Soc. Mass Spectrom.* 2011, vol. 22, 1070-1078).

In the method explained above, k(E) of a peptide ion is needed to estimate its early plume temperature by the kinetic method. The present inventors showed that k(E) itself could be estimated by using the above method in reverse and reported the dissociation kinetic parameters of $E_0$=0.660 eV and $\Delta S\ddagger$=−27.2 eu (1 eu=4.184 J $mol^{-1}$ $K^{-1}$) for $[Y_5R+H]^+$ and $E_0$=0.630 eV and $\Delta S\ddagger$=−27.6 eu for $[Y_5K+H]^+$. For each peptide ion, RRKM (Rice-Ramsperger-Kassel-Marcus) rate-energy relation (k(E)) calculated with the above $E_0$ and $\Delta S\ddagger$ was used to determine the early plume temperature under various experimental conditions.

With reference to FIG. 1 regarding peptide ion, $[Y_6+H]^+$, the abundances of peptide-related ions shown in MALDI spectrum is measured and, then, from these data the survival probability of peptide ions in the ion source is estimated. Considering MALDI measurement conditions, the maximum rate constant of the survived peptide ions is obtained. Then, the internal energy distribution of the peptide ion with change of temperature is estimated, and the temperature at which the probability of the area below the maximum rate constant is the same as the survival probability ($S_{in}$) is taken.

Example 2

Shot Number Dependence of the Overall Spectral Pattern

Figure 2:
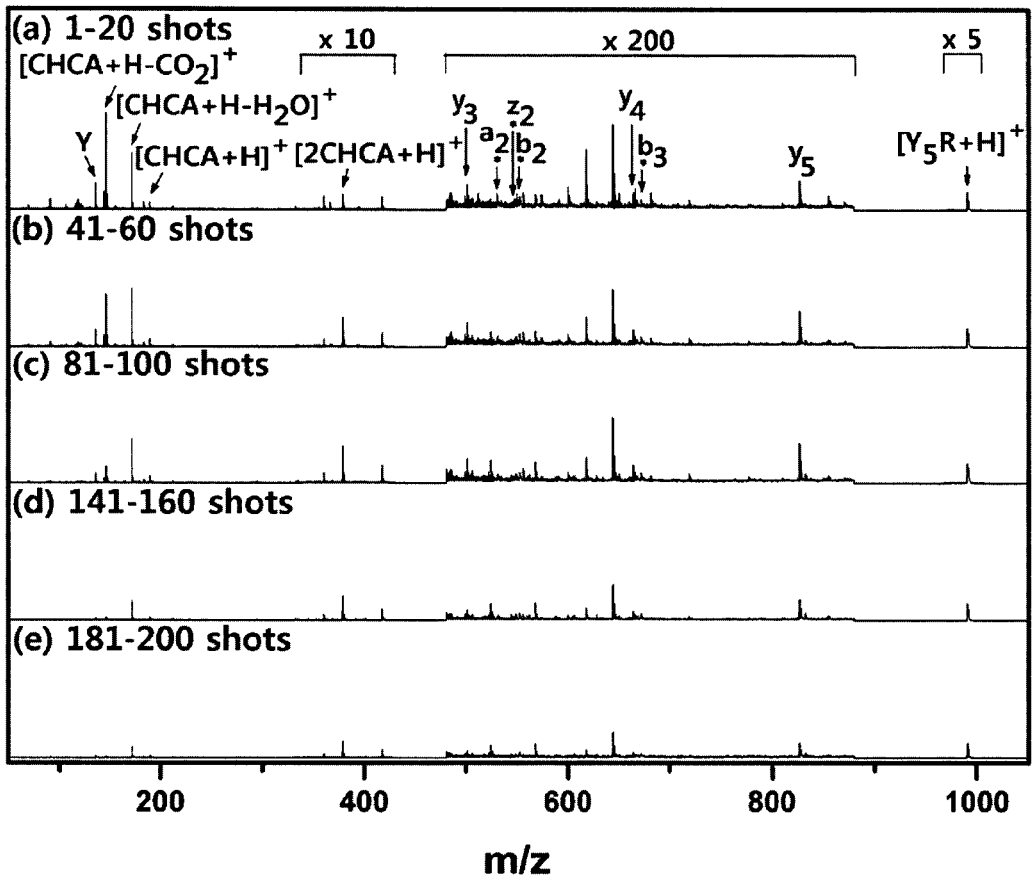
FIG. 2 illustrates MALDI spectra obtained by irradiating repetitively at 337 nm laser pulses on a spot on a sample with 3 pmol of $Y_5R$ in 25 nmol of CHCA (α-cyano-4-hydroxy-cinnamic acid) in Example 2.

By repetitively irradiating a spot on a sample with 337 nm nitrogen laser and collecting data, a set of MALDI spectra was obtained. Some of those from the first two hundred shots in MALDI of 3 pmol of $Y_5R$ in 25 nmol CHCA obtained with six times the threshold are shown in FIG. 2. MALDI spectra in FIG. 2 were integrated in the shot number ranges of (a) 1-20, (b) 41-60, (c) 81-100, (d) 141-160, and (e) 181-200. In addition to the peptide ($[Y_5R+H]^+$) and matrix ($[CHCA+H]^+$) ions, their ISD product ions appear in the spectra such as the immonium ion Y from the peptide ion, and $[CHCA+H-H_2O]^+$ and $[CHCA+H-CO_2]^+$ from the matrix ion. The matrix dimer ion, $[2CHCA+H]^+$, also appears (PSD peaks are marked with *). Other ISD product ions from the peptide ion, that were mostly b, y, and their consecutive dissociation products, were very weak compared to the immonium ion Y. PSD peaks from the peptide ion were also very weak. Weak but distinct peaks left unassigned in the figure originate from the matrix. Even though the same ions appear in all the MALDI spectra shown in FIG. 2, their relative abundances change with the shot number. Surprisingly, it was observed that the shot number-dependent variation of the spectral pattern was quite reproducible, within 10-20 shots.

As mentioned above, three factors characterizing the overall pattern of a MALDI spectrum was the peptide-to-matrix ion abundance ratio and the fragmentation patterns of peptide and matrix ions. All of these changed as the shot continued, as can be seen in FIG. 2. First, the abundance of the immonium ion Y relative to that of the peptide ion decreased steadily (the same also occurred for other ISD product ions). Second, the mass spectral pattern for the matrix changed steadily, the relative abundance of $[CHCA+H-CO_2]^+$ getting weaker. Third, the peptide-derived ions became relatively more abundant than the CHCA-derived ions.

Figure 3:
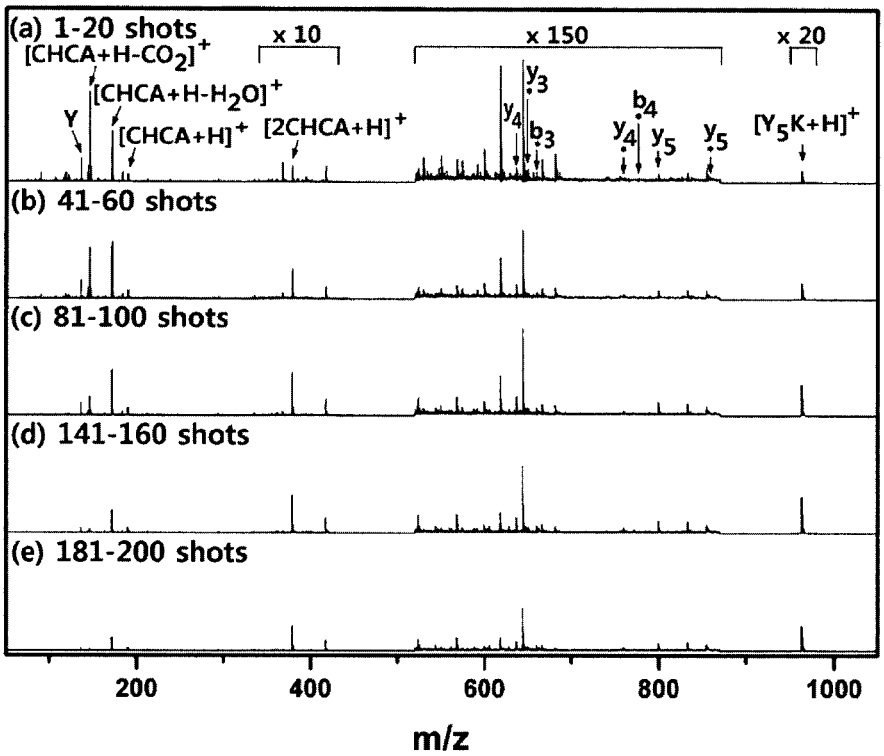
FIG. 3 illustrates MALDI spectra obtained by irradiating repetitively at 337 nm laser pulses on a spot on a sample with 3 pmol of $Y_5K$ in 25 nmol of CHCA in Example 2.
Figure 4:
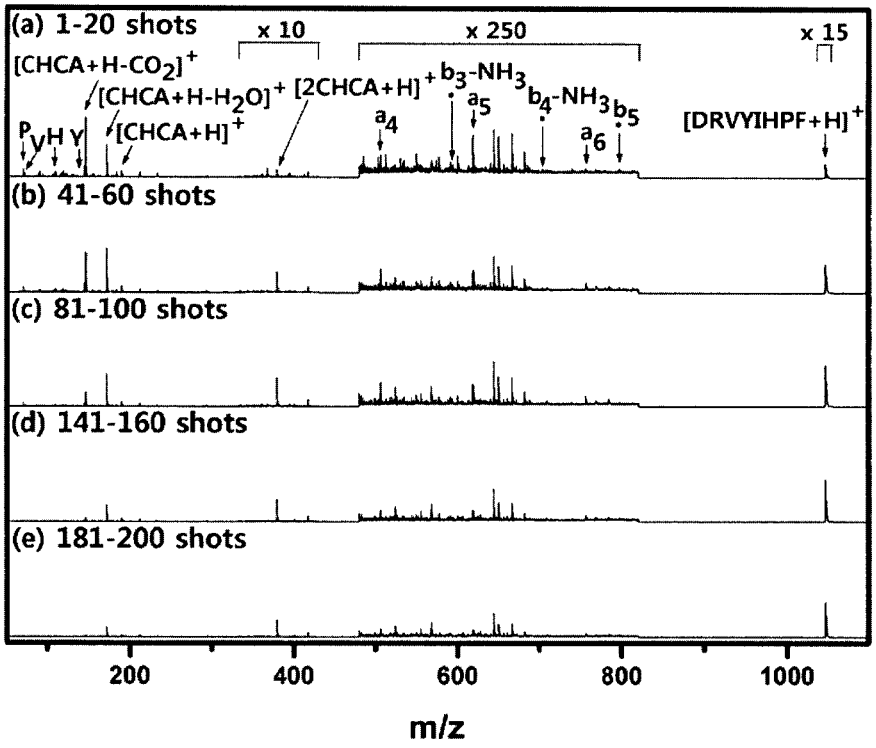
FIG. 4 illustrates MALDI spectra obtained by irradiating repetitively at 337 nm laser pulses on a spot on a sample with 3 pmol of angiotensin II (DRVYIHPF) in 25 nmol of CHCA in Example 2.

Similar trends for the other peptides, $Y_5K$ (FIG. 3) and angiotensin II (FIG. 4) were observed. FIG. 3 illustrates MALDI spectra where a spot on a sample with 3 pmol of $Y_5K$ in 25 nmol of CHCA was irradiated repetitively at 337 nm laser pulses with six times the threshold pulse energy, and each spectrum was integrated in the shot number ranges of (a) 1-20, (b) 41-60, (c) 81-100, (d) 141-160 and (e) 181-200. Immonium ion Y was the major ISD product of $[Y_5K+H]^+$, and $[CHCA+H-H_2O]^+$ and $[CHCA+H-CO_2]^+$ were the ISD products of $[CHCA+H]^+$ (PSD peaks are marked with *). FIG. 4 illustrates MALDI spectra where a spot on a sample with 3 pmol of angiotensin II (DRVYIHPF) in 25 nmol of CHCA was irradiated repetitively at 337 nm laser pulses with six times the threshold pulse energy, and each spectrum was integrated in the shot number ranges of (a) 1-20, (b) 41-60, (c) 81-100, (d) 141-160 and (e) 181-200. Immonium ion, P, V, H, Y are the major ISD products of $[DRVYIHPF+H]^+$, and $[CHCA+H-H_2O]^+$ and $[CHCA+H-CO_2]^+$ were the ISD products of $[CHCA+H]^+$ (PSD peaks are marked with *).

Example 3

Shot Number Dependence of the Effective Temperature

Figure 5:
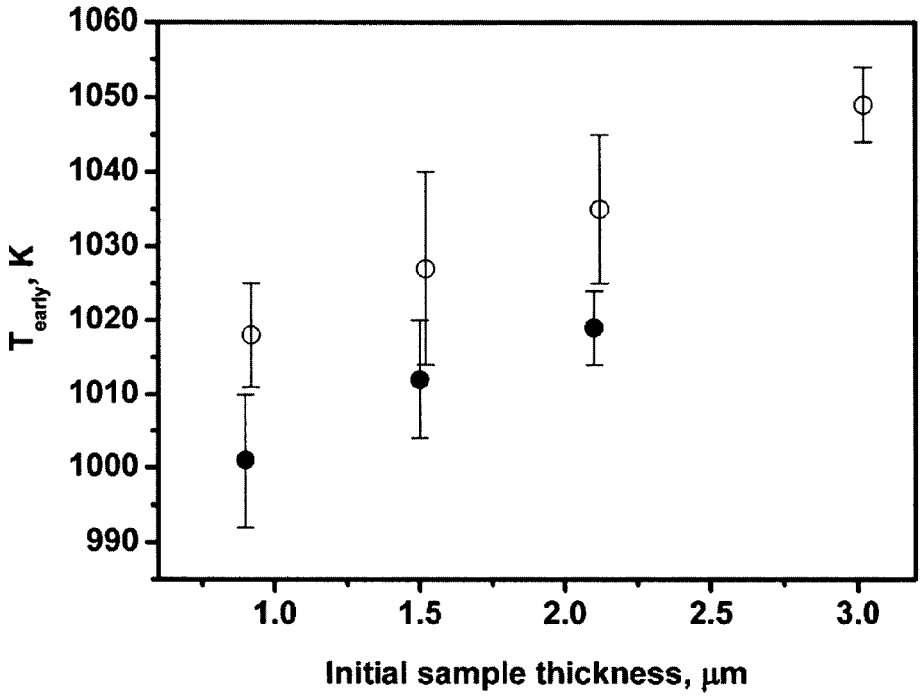
FIG. 5 is a graph illustrating the change of the early plume temperature ($T_{early}$) with change of a sample thickness in Example 3.

Decrease in the relative abundances of the ISD products means that the average internal energy of the peptide ion decreased steadily as the shot continued. Under the assumption of thermal equilibrium in the early plume, this means that $T_{early}$ was getting lower. One thing that happens as the irradiation continues is the gradual decrease in the sample thickness at the irradiated spot. Therefore, $T_{early}$ gets lower as the sample gets thinner. In order to see if more efficient thermal conduction in a thinner sample was responsible for the steady decrease in $T_{early}$, samples with the same composition ($Y_5R$:CHCA=1:25000) but with different thickness (0.9-2.1 μm) were prepared. Similar samples on the hydrophobic part of an anchor chip plate coated with 50 nm fluorocarbon layer were also prepared. The laser pulse energy was kept at 6 times the threshold and the spectra were averaged over the first twenty shots. For each spectrum, $T_{early}$ was estimated from $S_{in}$. $T_{early}$ vs. initial sample thickness plot shown in FIG. 5 (bare stainless steel surface: •; fluorocarbon layer: ○) is consistent with the hypothesis that thermal conduction is more efficient in a thinner sample. $T_{early}$ for samples loaded on the fluorocarbon layer was higher than that on the bare metal plate, suggesting that the fluorocarbon layer played an insulator to the heat flow. Consequently, $T_{early}$ can be determined from the peptide ion dissociation yield and the temperature goes down as the shot continues.

Example 4

Shot Number Dependence of the Fragmentation Pattern for $[CHCA+H]^+$

Figure 6:
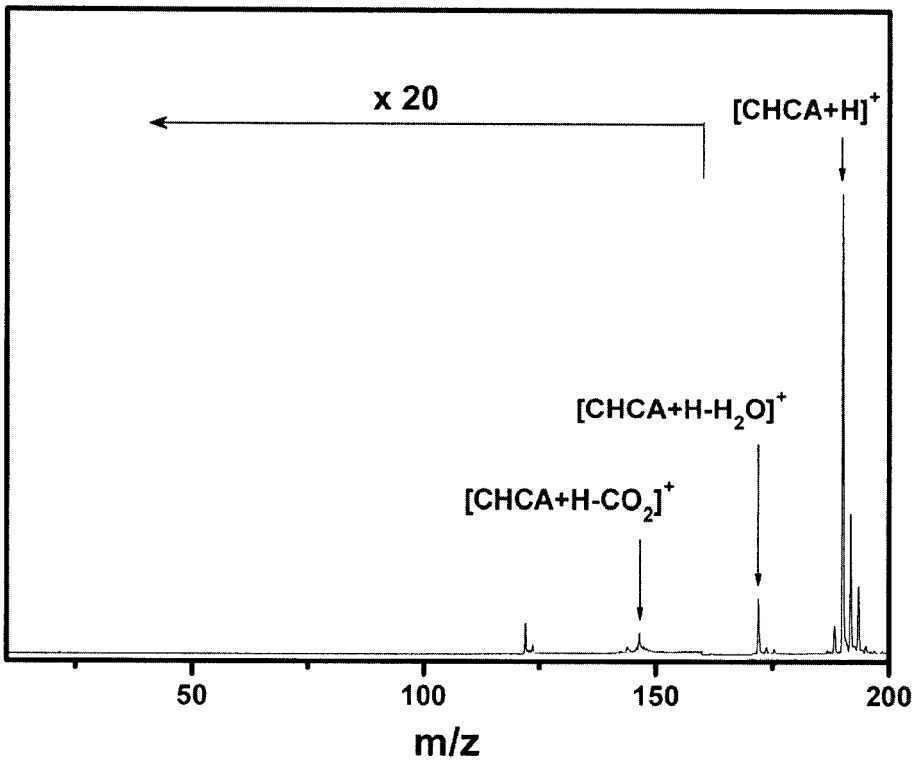
FIG. 6 is PSD spectra of $[CHCA+H]^+$ in Example 4.

Since the time span for PSD (around 10 μs) is significantly longer than that of ISD (several tens of nanosecond), or the rate constant for PSD is smaller, a lower energy process is relatively more favored in PSD than in ISD. In the PSD spectrum of $[CHCA+H]^+$ (FIG. 6), $[CHCA+H-H_2O]^+$ was the most abundant product while $[CHCA+H-CO_2]^+$ was only 10% of $[CHCA+H-H_2O]^+$ in abundance, indicating that the loss of $H_2O$ is a lower energy process than that of $CO_2$. In the MALDI spectra shown in FIG. 2, the abundance of $[CHCA+H-CO_2]^+$ generated by ISD relative to that of $[CHCA+H-H_2O]^+$ decreased steadily as the shot continued. This was consistent with the fact that $T_{early}$ got lower as the shot continued. That is, the mass spectral pattern of CHCA seems to be thermally determined, as was assumed to be the case for the peptide.

Example 5

Peptide-to-Matrix Ion Abundance Ratio

Figure 7:
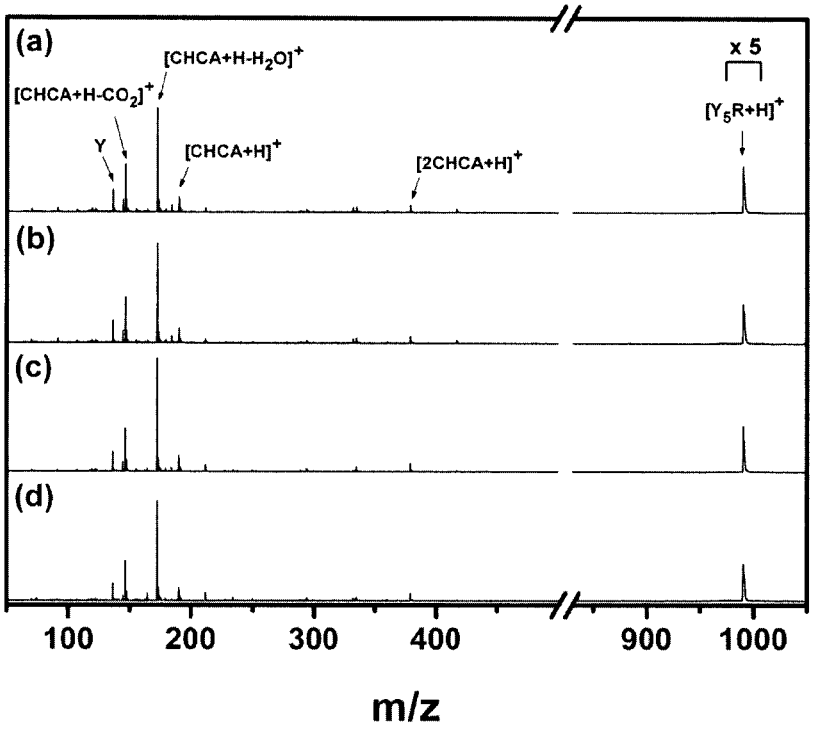
FIG. 7 shows spectra with $T_{early}$ near 968 K selected from each MALDI spectral set for samples with $Y_5R$:CHCA=1:8300 in Example 5.

Sets of spectra for samples with the peptide-to-matrix ratio of 1:8300 under four different experimental conditions were collected. Denoting an experimental condition as (# pmol of $Y_5R$, # nmol of CHCA, pulse energy in unit of the threshold, laser wavelength in nm), they were (a) (3, 25, ×6, 337), (b) (3, 25, ×4, 337), (c) (4.2, 35, ×6, 337), and (d) (3, 25, ×6, 355). Four spectra with $T_{early}$ near 968 K, one from each set, are shown in FIG. 7(*a*)-(*d*), which are virtually the same. Similar one-to-one-to-one-to-one correspondence was also observed at other temperatures.

Figure 8:
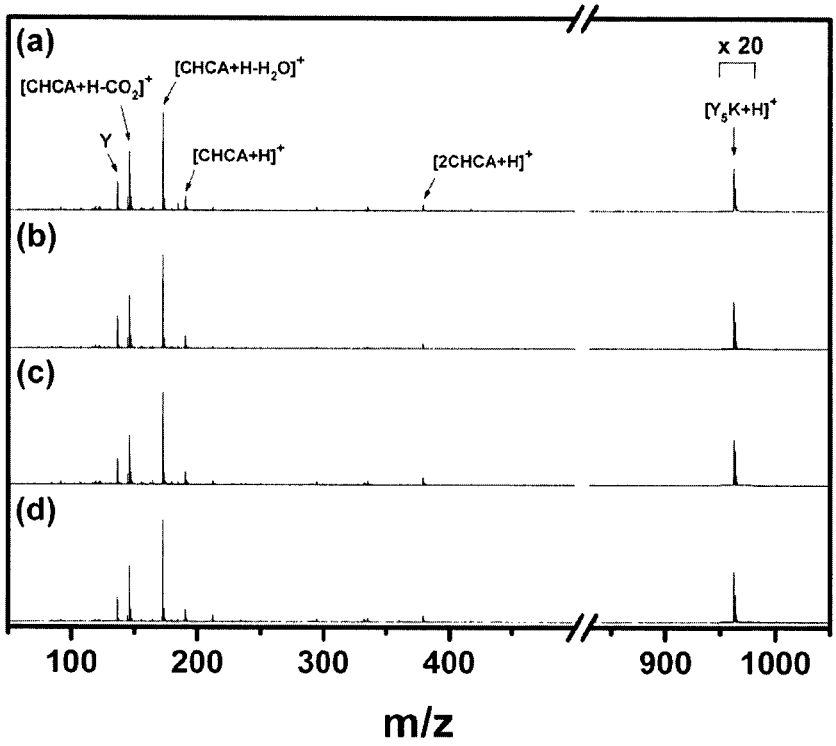
FIG. 8 shows spectra with $T_{early}$ near 968 K selected from each MALDI spectral set for samples with $Y_5K$:CHCA=1:8300 in Example 5.
Figure 9:
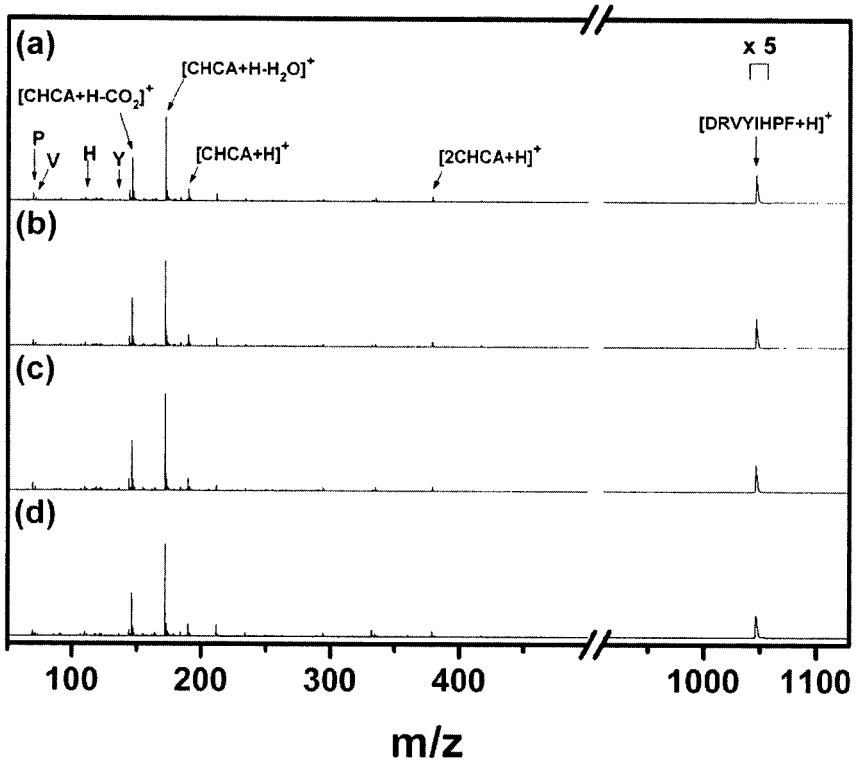
FIG. 9 shows spectra with $T_{early}$ near 968 K selected from each MALDI spectral set for samples with angiotensin II (DRVYIHPF):CHCA=1:8300 in Example 5.

In addition, similar correspondence for $Y_5K$ and angiotensin II were observed. FIG. 8 illustrates MALDI spectra of samples of $Y_5K$:CHCA (peptide-to-matrix ratio) of 1:8300 with $T_{early}$ near 968 K, which were selected from sets of MALDI spectra obtained at the four conditions of (a) (3, 25, ×6, 337) (shot number range of 61-80), (b) (3, 25, ×4, 337) (shot number range of 41-60), (c) (4.2, 35, ×6, 337) (shot number range of 71-90), and (d) (3, 25, ×6, 355) (shot number range of 21-40). FIG. 9 illustrates MALDI spectra of samples of angiotensin II (DRVYIHPF):CHCA (peptide-to-matrix ratio) of 1:8300 with $T_{early}$ near 968 K, which were selected from sets of MALDI spectra obtained at the four conditions of (a) (3, 25, ×6, 337) (shot number range of 71-90), (b) (3, 25, ×4, 337) (shot number range of 31-50), (c) (4.2, 35, ×6, 337) (shot number range of 81-100), and (d) (3, 25, ×6, 355) (shot number range of 21-40).

That is, MALDI spectra for peptides turned out to be reproducible once those tagged by the same $T_{early}$ were compared. For samples with different peptide-to-matrix ratios, the same fragmentation patterns for the peptide and matrix ions at the same $T_{early}$ were observed, while the peptide-to-matrix ion abundance ratios were different.

Example 6

Equilibrium of Proton Transfer Reaction

Figure 10:
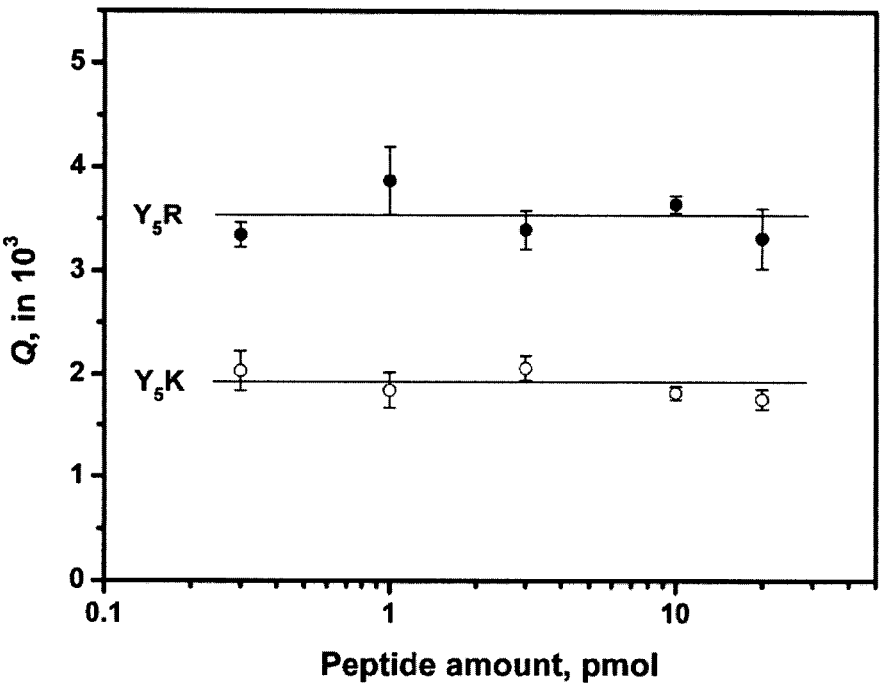
FIG. 10 illustrates a reaction quotient for proton exchange of $Y_5R$ and $Y_5K$ with the matrix, obtained in Example 6.

Matrix-to-peptide proton transfer occurs in MALDI mass spetrometry, i.e., $ME^+ + P \rightarrow M' + PH^+$. The $M'H^+$ is the proton donor that might be $[CHCA+H]^+$, $[CHCA+H-H_2O]^+$, or $[CHCA+H-CO2]^+$ in the present case. The fact that the peptide-to-matrix ion abundance ratio is thermally determined suggests that the proton transfer is almost in thermal equilibrium. One way of checking such a possibility is to measure the reaction quotient, $Q=([M']/[P])([PH^+]/[M'H^+])$, for samples with various peptide concentrations at a specified $T_{early}$ and see if it is independent of the concentration. Accordingly, the present inventors recorded a set of MALDI spectra by repetitively irradiating a sample containing 0.3-20 pmol of $Y_5R$ or $Y_5K$ in 25 nmol of CHCA and determined $T_{early}$ for each spectrum. Then, selected was one spectrum from each set with a specified value of $T_{early}$, thereby generating a new set with the same $T_{early}$ but different composition in the solid sample. The abundances of the matrix- and analyte-derived ions were measured for the spectra in the new set. At this stage, one needs to know the identity of $M'H^+$ to calculate Q. However, as far as checking the constancy of Q is concerned, one can use the abundance of any of the potential proton donors mentioned above, or their combinations, because the relative abundances of all the matrix-derived ions were fixed when $T_{early}$ was fixed. The concentration independence of the fragmentation pattern of matrix ions further suggests that a fragment ion such as $[CHCA+H-H2O]^+$ is not the main proton donor because, if it were, its abundance would decrease more rapidly than that of $[CHCA+H]^+$ as the amount of peptide increases. That is, it is likely that $[CHCA+H]^+$ is the main proton donor. Assuming that some of the matrix ions that survive deprotonation undergo fragmentation, the present inventors took the total abundance of the matrix-derived ions, Σ[matrix-derived ion], as $[M'H^+]$ in the calculation of Q. Similarly, Σ[peptide-derived ion] was used as $[PH^+]$. For the concentration ratio of the neutrals in the gas phase, i.e., ([M']/[P]), the matrix-to-peptide ratio in the solid sample was used. Q values determined at $T_{early}$ of 950 K vs the peptide amount are plotted in FIG. 10 (•: $Y_5R$; ○: $Y_5K$). It is evident from FIG. 10 that Q is essentially independent of the peptide amount, indicating that the proton transfer reaction is almost in thermal equilibrium. That is, Q shown in FIG. 10 is essentially the equilibrium constant, K. K for the matrix-to-peptide proton transfer is larger for $Y_5R$ than for $Y_5K$, in agreement with the fact that arginine (R) is a stronger base than lysine (K).

Example 7

Calibration Curve

Laser pulses were irradiated on one spot of samples containing 10 fmol-30 pmol of $Y_5R$ or $Y_5K$ in 25 nmol of CHCA. MALDI spectra were obtained by irradiation of laser pulses on the spot until ion signals disappeared. For each spectrum, $T_{early}$ was determined by analyzing peptide ion fragmentation pattern. Then, a set of spectra with the same $T_{early}$ of 870 K-900 K were selected from each set of spectra. Since the peptide ion fragmentation changed with $T_{early}$, the fragmentation pattern was used as means for measurement of $T_{early}$. A set of spectra with the $[CHCA+H-H2O]^+/[CHCA+H]^+$ ionabundance ratio lying in the range of 3.0-4.5 were selected. As shown in the calibration curve in FIG. 11, $[AH^+]/[MH^+]$ is directly proportional to [A]/[M] in $Y_5R$ (FIGS. 11(*a*) and 11(*b*)) and $Y_5K$ (FIGS. 11(*c*) and 11(*d*)).

Example 8

Quantification—Use of Calibration Curve

Samples with nine peptides (0.3 pmol each), and 1.0 pmol of tamoxifen in 25 nmol of CHCA were prepared. MALDI spectra for the samples are shown in FIG. 12. In FIG. 12, $T_{early}$ with the $[CHCA+H-H2O]^+/[CHCA+H]^+$ ionabundance ratio lying in the range of 3.0-4.5, i.e., $T_{early}$ of 870 K-900 K, was selected. Quantification results of $Y_5R$ and $Y_5K$ contained in the samples, obtained by using the calibration curve in FIG. 11, are listed in Table 1.

TABLE 1

| | $Y_5R$ | $Y_5K$ |
|---|---|---|
| Amount loaded (pmol) | 0.30 | 0.30 |
| Amount determined (pmol) | 0.25 | 0.26 |

Figure 11:
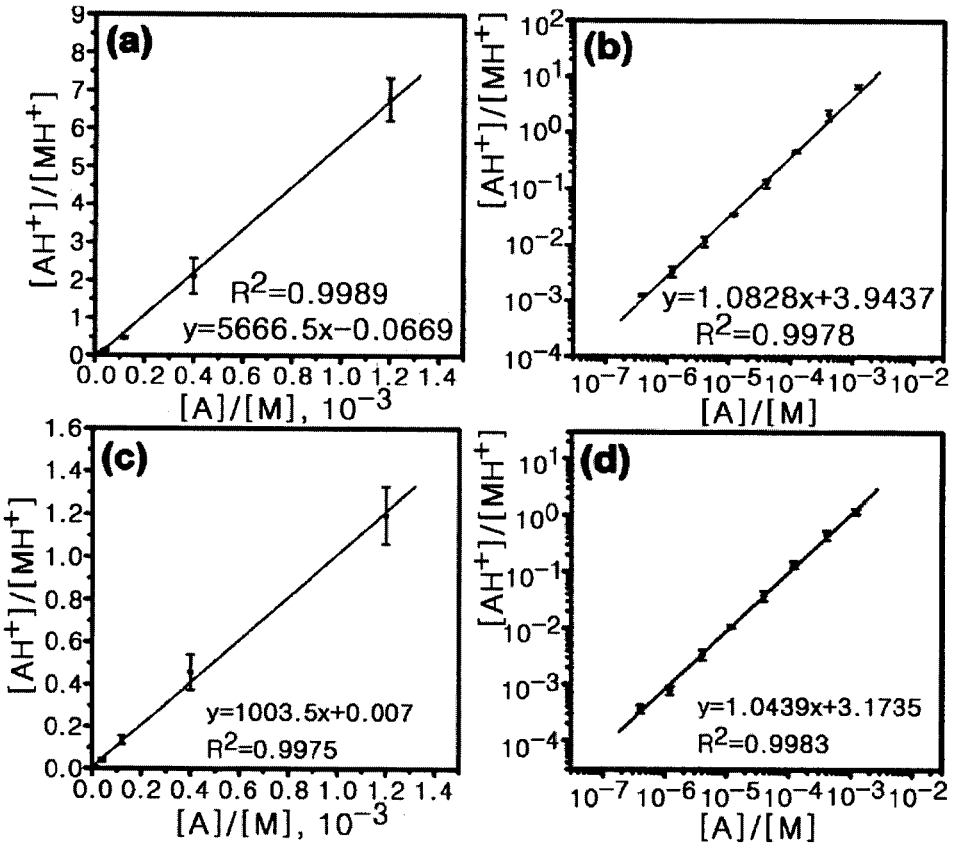
FIG. 11 shows calibration curves for MALDI quantitative analyses of $Y_5R$ and $Y_5K$, obtained in Example 7.
Figure 12:
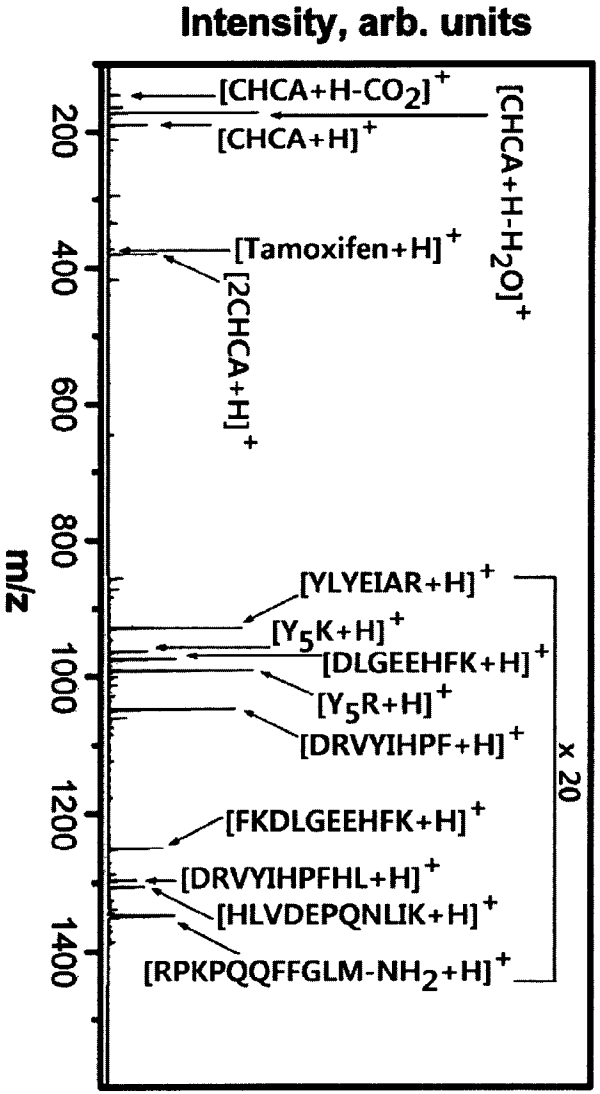
FIG. 12 illustrates MALDI spectra for samples with nine peptides, and tamoxifen in a matrix, obtained in Example 8.

As shown in FIG. 11, $[AH^+]/[MH^+]$ is almost directly proportional to [A]/[M]. Therefore, an analyte can be quantified by one-point calibration, i.e. by utilizing the ion abundance data at one concentration. Results of one-point calibration for each component in the samples are listed in Table 2.

TABLE 2

| Analyte | Amount loaded (pmol) | Amount determined (pmol) | Calibration curve |
|---|---|---|---|
| YLYEIAR | 0.30 | 0.31 | y = 2510.3x |
| $Y_5K$ | 0.30 | 0.24 | y = 954.0x |
| DLGEEHFK | 0.30 | 0.32 | y = 1226.6x |
| $Y_5R$ | 0.30 | 0.27 | y = 3162.6x |
| DRVYIHPF | 0.30 | 0.24 | y = 3098.1x |
| FKDLGEEHFK | 0.30 | 0.37 | y = 859.3x |
| DRVYIHPFHL | 0.30 | 0.33 | y = 544.1x |
| HLVDEPQNLIK | 0.30 | 0.40 | y = 521.5x |
| RPKPQQFFGLM-$NH_2$ | 0.30 | 0.31 | y = 1945.2x |
| tamoxifen | 1.0 | 0.74 | y = 886.0x |

As seen from the result of tamoxifen in Table 2, the methods herein may be applicable to all the analyte that can be ionized by MALDI.

Example 9

Measure of Spectral Temperature—Total Ion Count (TIC)

Peptides $Y_6$, $Y_5K$, and angiotensin II (DRVYIHPF) were purchased from Peptron (Daejeon, Korea). Matrices CHCA and DHB were purchased from Sigma (St. Louis, Mo., USA). Aqueous solution of an analyte(s) was mixed with 1:1 water/acetonitrile solution of CHCA or DHB. In CHCA-MALDI, 1.0 μL of a solution containing 0-250 pmol of analyte and 25 nmol of CHCA was loaded on the target and vacuum- or air-dried. Sampling for DHB-MALDI of $Y_6$ was carried out in two steps. In each step, 1 μL of a solution containing 0.5-320 pmol of $Y_6$ and 50 nmol of DHB was loaded and vacuum-dried.

It is not required to use kinetic analysis of anlayte ion fragmentation in order to measure $T_{early}$ of MALDI spectrum. Fragmentation pattern of a matrix ion, or total number of ions generated may be used as an indicator for $T_{early}$. However, $T_{early}$ cannot be easily determined in these methods when identities, concentrations and number of analytes in a sample change. Thus, a good measure of $T_{early}$, allowing for easy and rapid calculation of $T_{early}$, is required for substantial quantitative analysis, regardless of identities, concentrations and number of analytes in a sample. The following criteria are required for a good measure of $T_{early}$.

First, it must be a rather sensitive function of $T_{early}$. Second, the property must be rather independent of the nature of the analytes, such as their identities, concentrations in a solid sample, and their numbers. Third, it should be possible to compute this property rapidly and straightforwardly from a spectrum.

Determination of $T_{early}$ by using fragmentation pattern of an analyte ion does not satisfy the second and third criteria. Even when using the fragmentation pattern of a matrix ion, it is difficult to determine $T_{early}$ if matrix ion signals are contaminated by others. When the total number of ions generated in MALDI is used as a measure of $T_{early}$, the first and second criteria can be satisfied.

However, since it is difficult to measure total number of ions generated in MALDI due to loss of fragment products of ions generated inside a reflectron, the present inventors took the total number of particles detected in the detector as the total ion count (TIC), and used the TIC as a measure of $T_{early}$. In order to check that TIC is a function of $T_{early}$, the total number of ions and the TIC generated by a laser pulse when using 25 nmol of CHCA as a matrix, with change of identities, concentrations and number of analytes in a sample, are listed in Table 3.

TABLE 3

Total ion count (TIC) versus analyte concentration in CHCA-MALDI

| Analyte | Concentration (pmol)[a] | TIC per laser pulse[b] $T_{early}$ = 875 ± 5K | TIC per laser pulse[b] $T_{early}$ = 900 ± 5K |
|---|---|---|---|
| —[c] | 0 | 600 ± 60 | 1250 ± 130 |
| Y5K | 0.10 | 540 ± 90 | 1300 ± 80 |
| | 1.0 | 450 ± 50 | 1100 ± 110 |
| | 10 | 460 ± 50 | 1070 ± 70 |
| Y5R | 0.10 | 540 ± 50 | 1220 ± 40 |
| | 1.0 | 530 ± 160 | 1250 ± 130 |
| | 10 | 520 ± 100 | 1050 ± 120 |
| Mixture[d] | 1.0/analyte | 580 ± 50 | 1220 ± 30 |

[a]Number of picomoles of analyte in 25 nmol of CHCA in a solid sample
[b]Averages over three or more measurements with one standard deviation
[c]Pure CHCA
[d]1.0 pmol each of $Y_5K$, $Y_5R$, YLYEIAR, YGGFL, creatinine, and histamine in 25 nmol of CHCA As shown in Table 3, it is evident that TIC is not significantly affected by the identities, concentrations, and number of analytes in a sample. Also, TIC is very sensitive to $T_{early}$ change (875 K→900 K). Thus, TIC satisfies all the three criteria and, hence, can be a useful measure of $T_{early}$.

In addition, as in CHCA-MALDI, the total number of ions generated by a laser pulse in DHB-MALDI was virtually the same regardless of the identities, concentrations, and number of analytes in a solid sample as long as $T_{early}$ was the same. The TIC data calculated from the same spectra are listed in Table 4, which suggest that TIC can be used as a measure of $T_{early}$ in DHB-MALDI also.

TABLE 4

Total ion count (TIC) versus analyte concentration in DHB-MALDI

| Analyte | Concentration (pmol)[a] | TIC per laser pulse[b] $T_{early}$ = 780 ± 5K | TIC per laser pulse[b] $T_{early}$ = 800 ± 5K |
|---|---|---|---|
| —[c] | 0 | 480 ± 40 | 1510 ± 150 |
| Y6 | 2.0 | 430 ± 70 | 1310 ± 60 |
| | 20 | 460 ± 60 | 1400 ± 130 |
| Mixture[d] | 각각 2.0 | 500 ± 100 | 1300 ± 110 |

[a]Number of picomoles of analyte in 100 nmol of DHB in a solid sample
[b]Averages over three or more measurements with one standard deviation
[c]Pure DHB
[d]2.0 pmol each of Y6, Y5R, YLYEIAR, YGGFL, creatinine, and histamine in 100 nmol of DHB

Example 10

Quantitative Reproducibility of TIC-Selected Spectra

First, spectral changes occurring upon repetitive irradiation were observed. A set of MALDI spectra from a spot on a vacuum-dried sample with 10 pmol $Y_5K$ in 25 nmol of CHCA was taken, using two times the threshold pulse energy.

Figure 13:
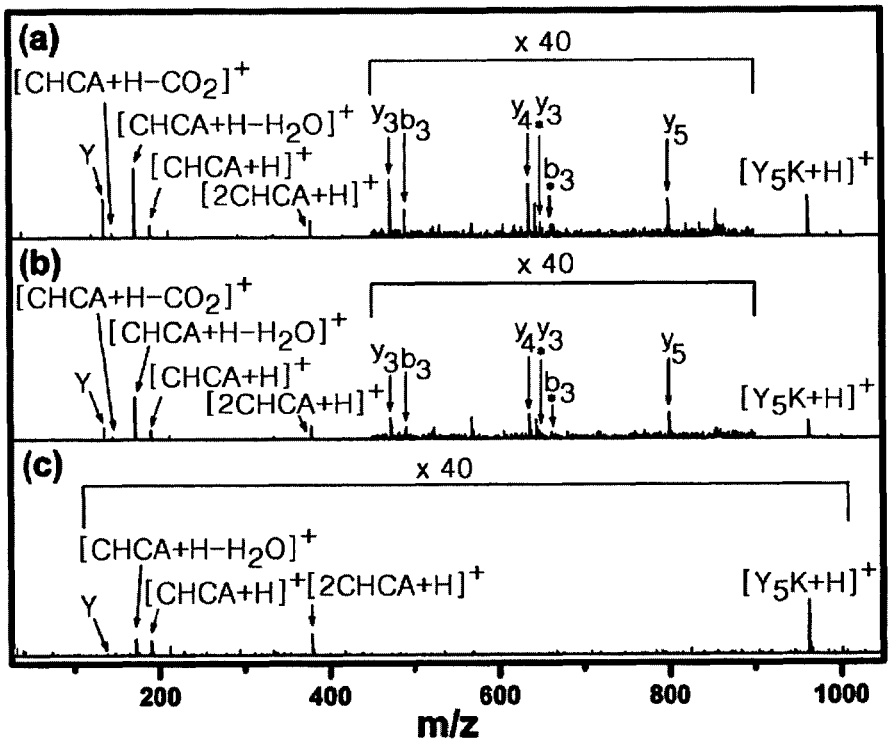
FIG. 13 shows MALDI spectra taken from a spot on a sample with 10 pmol $Y_5K$ in 25 nmol CHCA averaged over the shot number range of (*a*) 31-40, (*b*) 81-90, and (*c*) 291-300, obtained in Example 10.

From this set, those averaged over the shot number ranges of 31-40, 81-90, and 291-300 are shown in FIG. 13. The first 30 spectra from a fresh spot were not used because contamination by alkali adduct ions was significant in those spectra. The total TICs summed over the above shot number ranges were 12,000 (12,000), 7,300 (58,000), and 110 (106,000), respectively (the numbers in parentheses denote TICs accumulated in the shot number ranges of 31-40, 31-90, and 31-300, respectively). Since temperature selection was not made, both the spectral pattern and the abundance of each ion changed as the shot continued. At the shot number range of 291-300, $[Y_5K+H]^+$ became more prominent than others. However, its absolute abundance was very low compared to those at the shot number range of 31-40 or 81-90. In fact, ion generation virtually stopped after the shot number 300. This does not mean that materials at the irradiated spot were completely depleted at the shot number 300 because ion generation resumed when the laser pulse energy was raised. A simple explanation for this phenomenon is as follows. As the irradiated spot got thinner, the temperature at the spot got lower, eventually becoming lower than the threshold for ablation at the shot number 300. Then, the increase in pulse energy raised the temperature above the ablation threshold and the ion generation resumed.

In a previous work of the present inventors, it was reported that MALDI spectra obtained from a sample with a given composition were quantitatively reproducible regardless of the experimental condition when the spectra with the same $T_{early}$ were selected. In the previous work, the $I([M+H-H_2O]^+)/I([M+H]^+)$ ratio was used as the measure of $T_{early}$.

Figure 14:
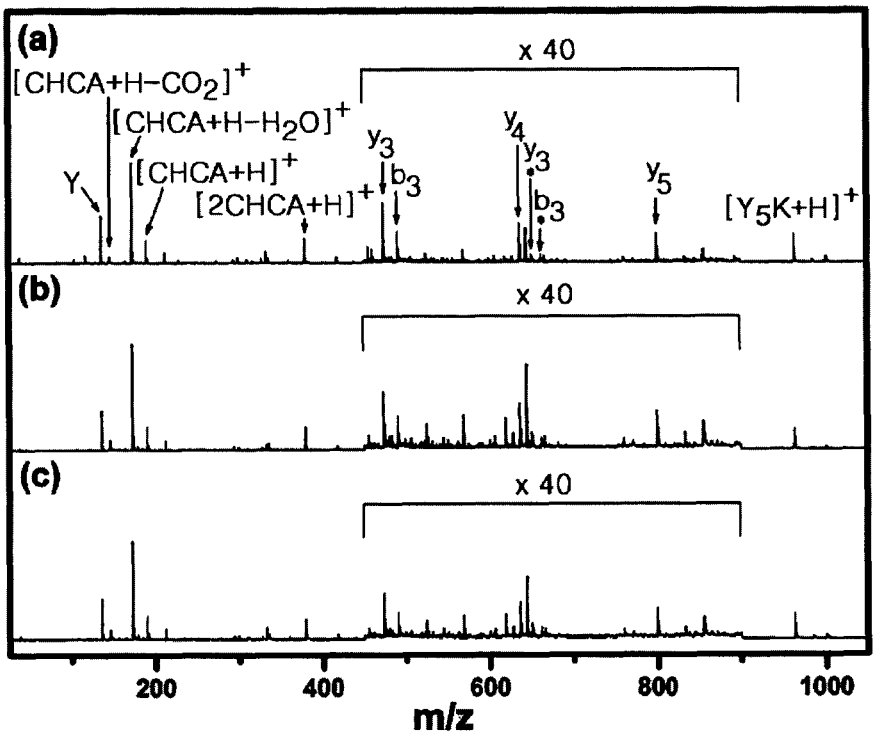
FIG. 14 illustrates TIC-selected MALDI spectra for a vacuum-dried sample of 10 pmol $Y_5K$ in 25 nmol CHCA obtained with (*a*) two, (*b*) three, and (*c*) four times the threshold laser pulse energy, obtained in Example 10.

In an embodiment, a similar measurement for a vacuum-dried sample of 10 pmol $Y_5K$ in 25 nmol CHCA was performed, this time selecting spectra with TIC of 1100±200 ions/pulse. As shown in FIG. 14, the spectra thus obtained are virtually the same. Also, similar results for angiotensin II in CHCA were obtained. The results indicate that TIC is an excellent measure of $T_{early}$. Moreover, the spot-to-spot and sample-to-sample reproducibilities were checked and it was found that the strategy of spectral acquisition-temperature selection utilizing TIC worked well.

Figure 15:
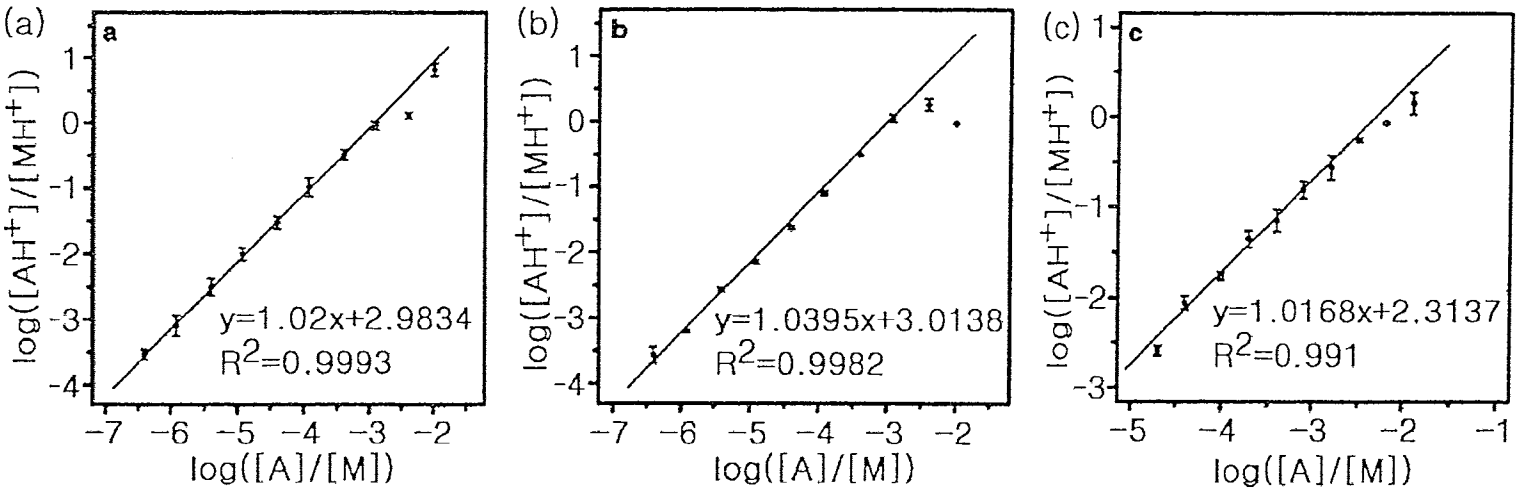
FIG. 15 shows calibration curves in CHCA-MALDI of $Y_5K$ obtained by TIC selection (900±180 ions/pulse), obtained in Example 10.

The present inventors obtained MALDI spectra for vacuum-dried samples containing 0.01-250 pmol of $Y_5K$ in 25 nmol CHCA, selected those with TIC of 900±180 ions/pulse, and calculated the $[AH^+]/[MH^+]$ versus [A]/[M] data from the spectra. The result is shown in FIG. 15(*a*). Excellent linearity of the calibration curve demonstrates the utility of TIC for temperature selection and, hence, for quantification.

Example 11

Acquisition of Reproducible Spectra by TIC Control

Laser pulse energy was adjusted in order to control TIC in MALDI spectra. Laser pulse energy was manually adjusted by rotating a circular variable neutral density filter (model CNDQ-4-100.0 M, CVI Melles Griot, Albuquerque, N. Mex., USA) installed immediately after the laser. This filter was mounted on a step motor assembly and the laser pulse energy was systematically adjusted by rotating the filter with a command from the data system.

The following negative feedback method turned out to be convenient for the temperature control. At the beginning of data acquisition from a spot, the laser pulse energy was adjusted to two times the threshold and 10 single-shot spectra were obtained and averaged. From the spectrum thus obtained, TIC was calculated and compared with a preset value, thereby calculating the adjustment needed for the laser pulse energy. The result was used to determine the rotational direction and angle for the filter. After the angular adjustment of the filter, spectral acquisition was resumed. Spectral acquisition from the spot was terminated when the materials in the spot got significantly depleted by repetitive laser irradiation. For CHCA-MALDI, termination was made when the laser pulse energy became three times the threshold.

Figure 16:
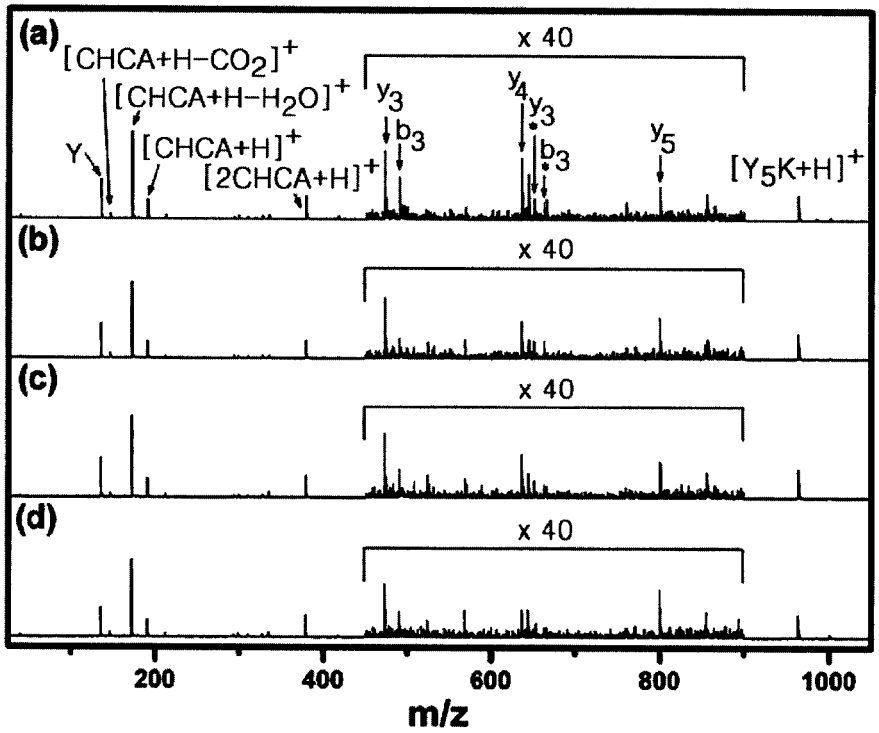
FIG. 16 illustrates TIC-controlled MALDI spectra taken from a spot on a sample with 10 pmol $Y_5K$ in 25 nmol CHCA using TIC of 900 ions/pulse as the preset value, averaged over the shot number ranges of (*a*) 31-40, (*b*) 81-90, (*c*) 131-140, and (*d*) 291-300, obtained in Example 11.

The experiment for a vacuum-dried sample with 10 pmol $Y_5K$ in 25 nmol CHCA was repeated, this time with the feedback adjustment of the laser pulse energy using TIC of 900 ions/pulse as the preset value. The spectra averaged over the shot number ranges of 31-40, 81-90, 131-140, and 241-250 are shown in FIG. 16. The total TICs in these shot number ranges were 9,000 (9,000), 8,600 (53,000), 9,000 (103,000), and 8,100 (188,000), respectively, with the numbers in the parentheses denoting TICs accumulated over the shot number ranges of 31-40, 31-90, 31-140, and 31-250, respectively. Spectral acquisition was terminated at the shot number 250, where the laser pulse energy became three times the threshold. As shown in FIG. 16, both the spectral patterns and ion abundances were similar throughout the measurement on the spot, demonstrating a successful acquisition of reproducible spectra by TIC control.

From the spectral set (FIG. 13) obtained without TIC control, those with TIC of 900±180 ions/pulse were selected. TIC summed over the spectra thus selected was 19,000 ions/pulse. That is, the accumulated TIC in the TIC-controlled spectra, 188,000 ions/pulse, was much larger than that in the TIC-selected spectra, suggesting that TIC control is more efficient than TIC selection in obtaining quantitatively reproducible MALDI spectra. In this method, the laser energy was adjusted by changing the transmission of the filter with the power of the nitrogen laser fixed.

Figure 17:
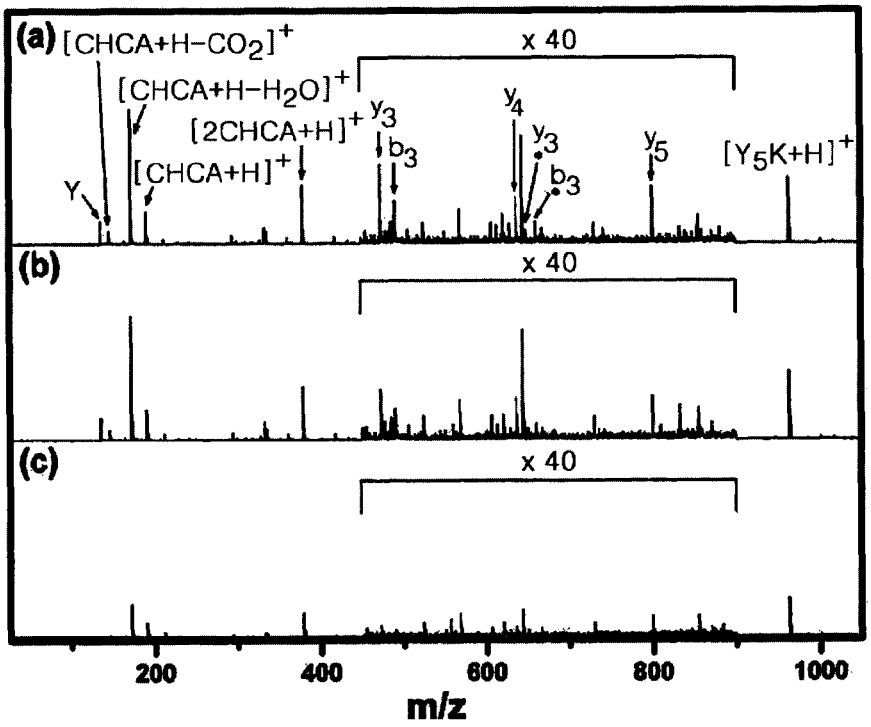
FIG. 17 shows TIC-controlled MALDI spectra taken from a spot on a sample with 10 pmol $Y_5K$ in 25 nmol CHCA using TIC of 2,500 ions/pulse as the preset value, averaged over the shot number ranges of (*a*) 31-40 and (*b*) 61-70, obtained in Example 11.

As an alternative approach to the above-mentioned method, the 355 nm output of a Nd:YAG laser (Surelite III-10, Continuum, Santa Clara, Calif., USA) for MALDI instead of the nitrogen laser was used in order to test the feasibility of this method. The threshold pulse energy at this wavelength was 0.25 μJ/pulse. 2,500 ions/pulse as the preset value for TIC was used, and data acquisition using two times the threshold pulse energy was started. After acquiring 10 spectra, TIC was measured and compared with the preset value. The pulse energy as an attempt to restore TIC to the preset value was adjusted. Here, the pulse energy was adjusted by changing the delay time for Q-switching—the actual methods of pulse energy adjustment can be different for different lasers. The first spectrum (shot number range of 31-40) in FIG. 17(*a*) was obtained using the pulse energy corresponding to 2 times the threshold. Then, the laser output was adjusted for TIC-control. The result obtained in the shot number range of 61-70 is shown in FIG. 17(*b*). The two spectra look similar demonstrating a successful reproduction of mass spectra through TIC control via laser output. For comparison, the result obtained at the same shot number range (61-70) obtained with the laser output fixed at 2 times the threshold is shown in FIG. 17(*c*). It can be seen that quantitatively reproducible spectra can be generated by the adjustment of laser output as was the case of the pulse energy adjustment with a neutral density filter.

Figure 18:
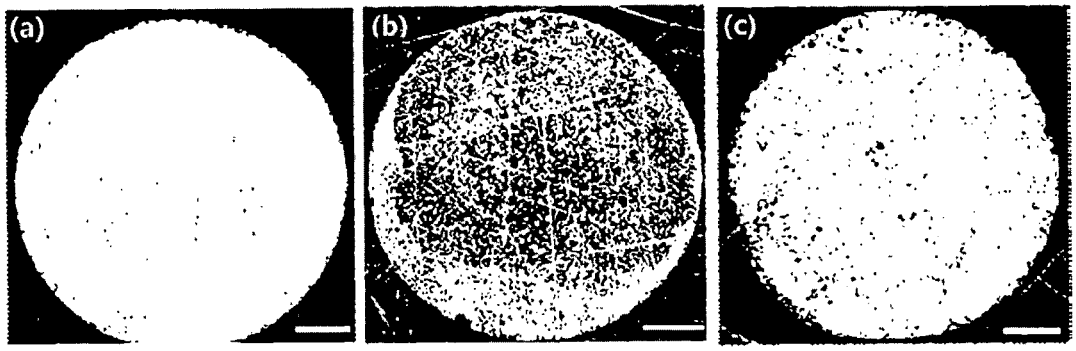
FIG. 18 shows photographs of samples with 10 pmol $Y_5K$ in 25 nmol CHCA prepared by (*a*) vacuum-drying and (*b*) air-drying, and (*c*) that of 20 pmol $Y_6$ in 100 nmol DHB prepared by vacuum-drying, obtained in Example 11 (scale bar=300 μm).

A sample prepared by vacuum-drying of peptide/CHCA solution was rather homogeneous. The photograph of a vacuum-dried sample is shown in FIG. 18(*a*). In order to check the spot-to-spot reproducibility of such a sample, TIC-controlled spectra at many spots on a vacuum-dried peptide/CHCA sample were acquired. The thus acquired spectra were similar regardless of the spot chosen for laser irradiation. Without TIC control, checking the spot-to-spot variation is meaningless because even the spectra obtained at the same spot are not reproducible.

When a solution with a given composition is loaded on the target and dried, the initial thickness of the solid sample will be affected by the volume of the solution loaded and by the diameter of the sample. This will affect $T_{early}$, which, in turn, will cause sample-to-sample irreproducibility in MALDI spectra. It looks obvious that such a problem can be handled easily by the present scheme because maintaining $T_{early}$ near a preset value is its main strategy. In order to check this, a sample using the same solution was prepared as was used to obtain the spectra in FIG. 16, but loaded 2.0 μL of the solution on the target instead of 1.0 μL used for FIG. 16. A measurement showed that doubling the volume of the solution increased the sample thickness by around 40%. TIC-controlled spectra were obtained from this sample using the same preset value for TIC as before, i.e., 900 ions/pulse. Their patterns were similar to those in FIG. 16, indicating that TIC control can reduce the errors caused at the time of sample loading.

Figure 19:
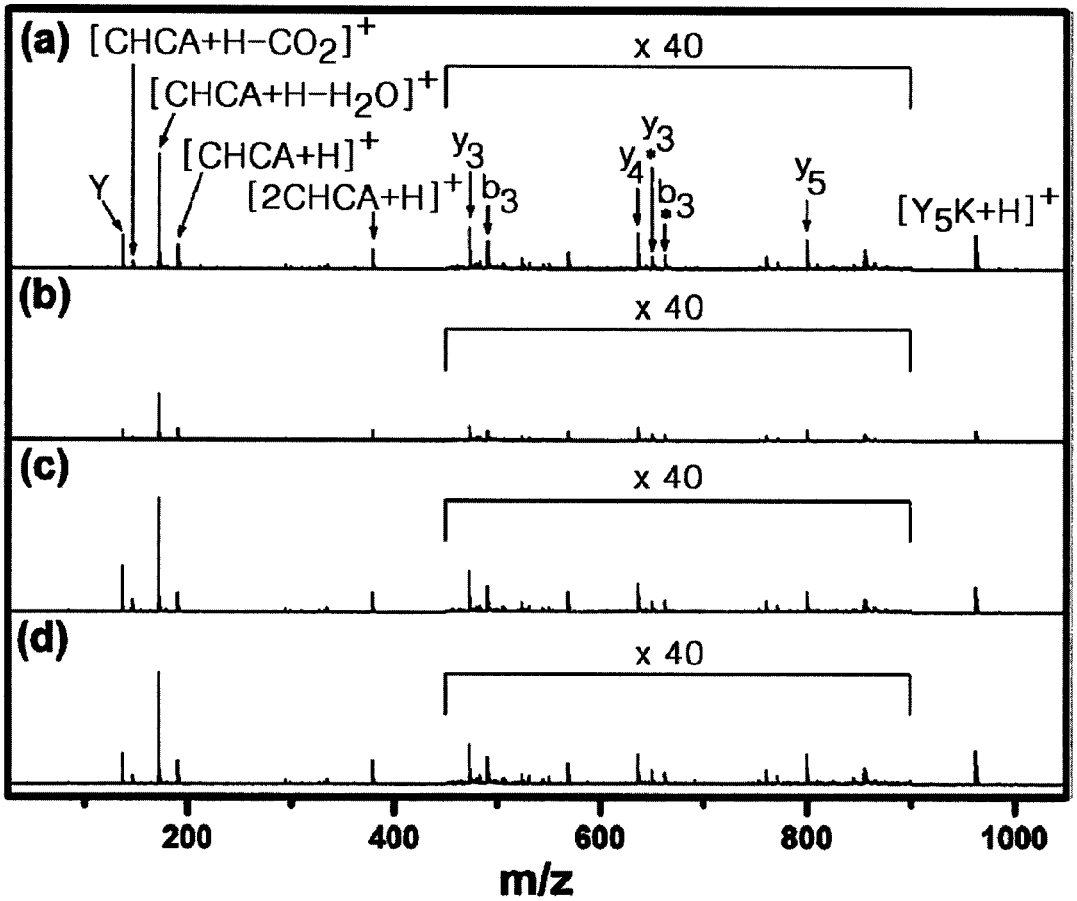
FIGS. 19(*a*) and 19(*b*) are MALDI spectra for an air-dried sample of 10 pmol $Y_5K$ in 25 nmol CHCA taken from two typical spots without TIC control, and FIGS. 19(*c*) and 19(*d*) are those for the same sample taken with TIC control using the preset value of 900 ions/pulse, obtained in Example 11.

Samples prepared by air-drying of a peptide/CHCA solution were not quite homogeneous. A photograph of an air-dried sample is shown in FIG. 18(*b*). Matrix crystallites are present as islands (FIG. 18(*b*)), whereas those in a vacuum-dried sample form a rather continuous film (FIG. 18(*a*)). In order to see the limitation to the spectral reproducibility imposed by sample inhomogeneity, samples with 10 pmol $Y_5K$ in 25 nmol CHCA were prepared by air-drying of the same solution used to obtain the spectra in FIG. 16. MALDI spectra taken from air-dried samples, without TIC control and averaged over each spot, displayed a significant spot-to-spot fluctuation, as demonstrated by two typical spectra shown in FIGS. 19(*a*) and 19(*b*). This is expected, partly because the number of crystallites on a laser focal spot of an air-dried sample fluctuates between 3 and 5.

Next, a similar experiment, this time with TIC control was performed. As demonstrated by two typical spectra shown in FIGS. 19(*c*) and 19(*d*), MALDI spectra obtained from different spots have become quantitatively similar (i.e., similar both in pattern and in absolute abundance of each ion, upon TIC control). Also, remarkable is the fact that the TIC-controlled spot-averaged spectra for air-dried samples in FIGS. 19(*c*) and 19(*d*) look rather similar to TIC-controlled spectra for a vacuum-dried sample in FIG. 16. Upon closer look, one finds that $T_{early}$ associated with the spectra obtained from air-dried samples tends to be slightly higher than that from the vacuum-dried sample even though the same preset value of TIC was used in both cases. For example, the $[CHCA+H-CO_2]^+$-to-$[CHCA+H]^+$ abundance ratio is a little larger for air-dried samples than for the vacuum-dried one. An explanation for the above difference is as follows. In order to generate the same numbers of ions from the two different samples, $T_{early}$ for the air-dried sample should be a little higher than that for the vacuum-dried one because the sample area exposed to laser irradiation is smaller for the former sample. Regardless, it is remarkable to note that the spectra obtained from two samples with significantly different morphology have become similar upon TIC control.

An $[AH^+]/[MH^+]$ versus [A]/[M] plot for vacuum-dried samples containing 0.01-250 pmol $Y_5K$ in 25 nmol CHCA was obtained by utilizing MALDI spectra selected based on TIC with TIC-control using TIC of 900 ions/pulse as the preset value. The calibration curve thus obtained is shown in FIG. 15(*b*). The calibration curve in FIG. 15(*b*) shows excellent linearity.

In addition, as in CHCA-MALDI, the total number of ions generated by a laser pulse in DHB-MALDI was virtually the same regardless of the identities, concentrations, and number of analytes in a solid sample as long as $T_{early}$ was the same. TIC data calculated from the same spectra are listed in Table 4, which suggest that TIC can be used as a measure of $T_{early}$ in DHB-MALDI also.

A set of TIC-controlled MALDI spectra was obtained by repetitive irradiation of a spot on a sample with 20 pmol $Y_6$ in 100 nmol DHB using TIC of 1,300 ions per pulse as the preset value. Both the spectral patterns and ion abundances are similar throughout the measurement on the spot, as in CHCA-MALDI. Also, the calibration curve for 1.0-640 pmol of Y6 in 100 nmol of DHB was obtained. Excellent linearity of the calibration curve shown in FIG. 15(*c*) demonstrates the utility of TIC control in quantification with DHB-MALDI.

Example 12

Matrix Signal Suppression Effect

Figure 20:
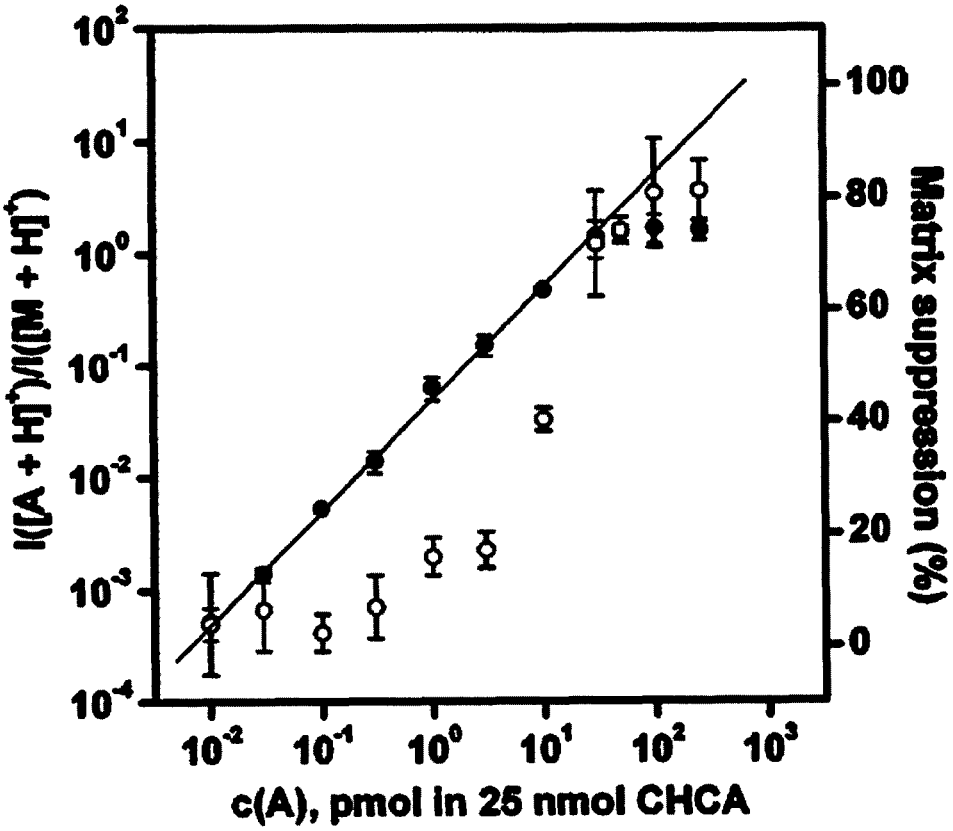
FIG. 20 shows a calibration curve for a peptide DLGEEHFK, obtained in Example 12. Percentages of matrix suppression are shown as open circles.

Samples containing 50 pmol of DLGEEHFK, and tryptic digest of 6.5 pmol of cytochrome c in 25 nmol of CHCA were prepared. According to the TIC-control method described in Example 11, MALDI spectra were obtained by setting TIC of 3,000 particles per shot. The calibration curve for DLGEEHFK obtained from the thus-obtained mass spectra is shown in FIG. 20. The matrix signal suppression effect for the sample was 94%. The amount of DLGEEHFK obtained by mass spectra was 9.7 pmol, while the accurate amount of DLGEEHFK was 50 pmol.

When the sample is diluted by a factor of 2, the matrix signal suppression effect was 78±7%, and this value is well matched with the value of 84% estimated by Eq. (4). However, the quantification result of the sample was 19±4 pmol, and this value is not good, comparing with the accurate value of 50 pmol.

When the sample is diluted by a factor of 10, the matrix signal suppression effect was 55±4%, and this value is well matched with the value of 59% estimated by Eq. (4). The quantification result of the sample was 51±6 pmol, and this value was well matched with the accurate value of 50 pmol.

What is claimed is:

1. A method for measuring an equilibrium constant of a proton transfer reaction between a matrix and an analyte at a certain temperature, the method comprising:

(i) selecting spectra of which fragmentation patterns of an analyte are the same with each other from a plurality of mass spectra obtained from ions generated by providing energy with a sample mixture comprising a matrix and an analyte; and (ii) obtaining an ion signal ratio calculated through dividing a signal intensity of an analyte ion shown in the spectra selected in the step (i) by a signal intensity of a matrix ion shown in the spectra selected in the step (i), wherein the equilibrium constant is obtained through dividing the ion signal ratio by a concentration ratio calculated through dividing an analyte concentration by a matrix concentration.

2. A method for measuring an equilibrium constant of a proton transfer reaction between a matrix and an analyte at a certain temperature, the method comprising:

(i) selecting spectra of which fragmentation patterns of a matrix are the same with each other, from a plurality of mass spectra obtained from ions generated by providing energy with a sample mixture comprising a matrix and an analyte; and (ii) obtaining an ion signal ratio calculated through dividing a signal intensity of an analyte ion shown in the spectra selected in the step (i) by a signal intensity of a matrix ion shown in the mass spectra selected in the step (i), wherein the equilibrium constant is obtained through dividing the ion signal ratio by a concentration ratio calculated through dividing an analyte concentration by a matrix concentration.

3. A method for measuring an equilibrium constant of a proton transfer reaction between a matrix and an analyte at a certain temperature, the method comprising:

(i) selecting spectra of which fragmentation patterns of a third material are the same with each other, from a plurality of mass spectra obtained from ions generated by providing energy with a sample mixture comprising a matrix, an analyte and the third material; and (ii) obtaining an ion signal ratio calculated through dividing a signal intensity of an analyte ion shown in the spectra selected in the step (i) by a signal intensity of a matrix ion shown in the spectra selected in the step (i), wherein the equilibrium constant is obtained through dividing the ion signal ratio by a concentration ratio calculated through dividing an analyte concentration by a matrix concentration.

* * * * *